US008448597B2

(12) United States Patent
Inoue et al.

(10) Patent No.: US 8,448,597 B2
(45) Date of Patent: May 28, 2013

(54) LIQUID APPLICATION APPARATUS, LIQUID APPLICATION METHOD, INKJET RECORDING APPARATUS AND INKJET RECORDING METHOD

(75) Inventors: Seiichi Inoue, Kanagawa (JP); Junichi Yoshida, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1191 days.

(21) Appl. No.: 12/318,090

(22) Filed: Dec. 22, 2008

(65) Prior Publication Data

US 2009/0165937 A1 Jul. 2, 2009

(30) Foreign Application Priority Data

Dec. 26, 2007 (JP) ..... 2007-334476

(51) Int. Cl.
*B05C 11/02* (2006.01)
*B05D 3/12* (2006.01)

(52) U.S. Cl.
USPC ..... 118/104; 427/359

(58) Field of Classification Search
None
See application file for complete search history.

(56) References Cited

U.S. PATENT DOCUMENTS 3,611,471 A * 10/1971 Meskanen ..... 15/256.51
4,428,090 A * 1/1984 Coggin et al. ..... 15/93.4
5,656,083 A * 8/1997 Schonberger ..... 118/107
6,203,615 B1 * 3/2001 Munch ..... 118/119
6,431,066 B1 * 8/2002 Perez et al. ..... 101/350.6
6,736,500 B2 5/2004 Takahashi et al.

FOREIGN PATENT DOCUMENTS

JP 2002-260639 A 9/2002
JP 2005-034733 A 2/2005
JP 2006-255611 9/2006
JP 2007-283665 A 11/2007
JP 2007-301993 A 11/2007

* cited by examiner

*Primary Examiner* — Dah-Wei Yuan
*Assistant Examiner* — Charles Capozzi
(74) *Attorney, Agent, or Firm* — Jean C. Edwards, Esq.; Edwards Neils PLLC

(57) ABSTRACT

A liquid application apparatus includes a rotatable coating cylinder having a circumferential surface onto which an application liquid is supplied; a base member which is conveyed continuously while making contact with the rotatable coating cylinder; a blade which scrapes off excess liquid of the application liquid in such a manner that a prescribed amount of the application liquid remains on the rotatable coating cylinder, before the rotatable coating cylinder transfers, onto the base member, the application liquid; a blade holding body which holds the blade, which is supported on a supporting shaft and is rotatable in a rotation direction; and a plurality of biasing devices which are disposed in an axial direction of the rotatable coating cylinder and bias the blade holding body in the rotation direction of the blade holding body in such a manner that the blade makes contact with the circumferential surface of the rotatable coating cylinder.

6 Claims, 15 Drawing Sheets

LIQUID APPLICATION APPARATUS, LIQUID APPLICATION METHOD, INKJET RECORDING APPARATUS AND INKJET RECORDING METHOD

CROSS-REFERENCE TO RELATED APPLICATIONS

The present application claims priority from Japanese Patent Application No. 2007-334476, filed Dec. 26, 2007, the contents of which are herein incorporated by reference in their entirety.

BACKGROUND OF THE INVENTION

1. Field of the Invention

The present invention relates to a liquid application apparatus, a liquid application method, an inkjet recording apparatus and an inkjet recording method, and more particularly, to technology whereby liquid that has been deposited in excess onto the surface of a coating cylinder as in gravure roller application, is scraped off to a prescribed application amount by a blade and the liquid is then applied to a base member.

2. Description of the Related Art

An inkjet recording method performs recording by ejecting droplets of ink respectively from a plurality of ejection nozzles which are formed in an inkjet head, and this type of method is used widely since it enables images of high quality to be recorded onto recording media of a wide variety of types, while incurring low running costs and producing little noise during the recording operation.

Furthermore, an inkjet recording method is also known which is a two-liquid method of promoting fixing of ink by forming an ink image by causing reaction of two liquids, namely, an ink and a treatment liquid which aggregates the ink.

In inkjet recording methods, intermediate transfer methods have been investigated in the related art, with the object of achieving good image formation onto recording media of various types, and in particular, a method which applies an undercoating liquid (treatment liquid), such as an ink aggregating agent, to an intermediate transfer body is suitable for forming images. When forming an image on cut paper using this system, reverse rolling application using a gravure roller is a suitable method, since it applies a film of undercoating liquid which has a suitably uniform thickness.

A liquid application apparatus based on a gravure roller system is composed in such a manner that liquid that has been deposited in excess on the surface of a gravure roller is scraped off to achieve a prescribed application volume by means of a doctor blade (hereinafter, simply called a "blade"), and the liquid is then applied to a base member.

However, in the case of a liquid application apparatus of this kind, when the front tip of a blade is placed in contact with the surface of a gravure roller and the applied liquid which has been deposited in excess on the surface of the gravure roller is thereby scraped off, there is a problem in that vibration of the blade occurs due to the contact between the blade and the gravure roller, and hence application defects such as step-shaped non-uniformities occur on the application surface of the base member onto which the application liquid is applied.

As a countermeasure for this, Japanese Patent Application Publication No. 2006-255611 teaches a gravure application method in which a structure for holding a blade is composed by supporting the blade by a blade supporting apparatus via a blade holder, and fastening the blade holder at a plurality of positions in the breadthways direction of the blade in a state where the blade holder is sandwiched between upper and lower blocks at the base end portion of the blade, and taking the contact force between the gravure roller and the blade to be F (kgf), taking the number of bolts to be n, and taking the fastening torque of the respective bolts to be T (kgfm), then the relationship $F \leqq 0.1 \times n \times T$ is satisfied. According to Japanese Patent Application Publication No. 2006-255611, it is possible to reduce the vibration of the blade and it is also possible to eliminate application defects such as step-shaped non-uniformities occurring due to vibration of the blade.

Nevertheless, in the invention described in Japanese Patent Application Publication No. 2006-255611, the blade which is fixed indirectly to the blade holder is caused to make contact with the gravure roller by three apparatuses, namely, an elevator apparatus, a rotating apparatus and a forward/reverse adjustment apparatus, in such a manner that the contact pressure is set by means of an amount of movement in extremely fine units, and therefore it is necessary to adjust the contact position each time there is even slight wear of the blade and hence there is a problem in that maintenance is very complicated. Furthermore, if a gap occurs between the blade and the gravure roller due to wear of the blade, then there is also a problem in that the performance in scraping off the excess application liquid is diminished and application defects arise. Moreover, since there are a large number of constituent components in the blade holding apparatus, then there is a further problem in that the application apparatus becomes complex and large in size.

Furthermore, in the invention described in Japanese Patent Application Publication No. 2006-255611, in order to measure the appropriate application contact pressure between the blade and the gravure roller, a tactile sensor is inserted between the blade and the gravure roller, and therefore it is necessary to measure the appropriate contact pressure each time there is even slight wear of the blade and maintenance becomes very complicated.

SUMMARY OF THE INVENTION

The present invention has been devised in view of these circumstances, an object thereof being to provide a liquid application apparatus, a liquid application method, an inkjet recording apparatus and an inkjet recording method whereby the maintenance properties are improved, as well as being able to prevent decline in the performance in scraping off excess application liquid even if the blade is worn.

In order to attain an object described above, one aspect of the present invention is directed to a liquid application apparatus comprising: a rotatable coating cylinder which has a circumferential surface onto which an application liquid is supplied at a lower portion of the rotatable coating cylinder; a base member which has a band shape and is conveyed continuously while making contact with an upper portion of the circumferential surface of the rotatable coating cylinder; a blade which scrapes off excess liquid of the application liquid which has been supplied to the circumferential surface of the rotatable coating cylinder in such a manner that a prescribed amount of the application liquid remains on the circumferential surface of the rotatable coating cylinder, before the upper portion of the circumferential surface of the rotatable coating cylinder transfers, onto the base member, the application liquid from which the excess liquid has been removed by the blade; a blade holding body which holds the blade, is supported on a supporting shaft and is rotatable in a rotation direction; and a plurality of biasing devices which are disposed in an axial direction of the rotatable coating cylinder and bias the blade holding body in the rotation direction of the blade holding body in such a manner that the blade makes contact with the circumferential surface of the rotatable coating cylinder.

According to this aspect of the invention, even if the blade suffers wear during use, since the blade holding body is biased continuously by the plurality of biasing devices disposed in the axial direction of the coating cylinder, in such a manner that the blade makes contact with the circumferential surface of the coating cylinder, then no gap occurs between the blade and the circumferential surface of the coating cylinder, and hence decline in the performance of scraping off excess application liquid is prevented and a film of application liquid of uniform thickness can be applied to the base member. Moreover, the replacement frequency of the blade is reduced and therefore the maintenance costs can be lowered. Furthermore, there is no need to measure the pressure with which the blade makes contact with the coating cylinder whenever there is wear of the blade, and hence maintenance can be simplified.

Desirably, the plurality of biasing devices are disposed at equidistant intervals in the axial direction of the rotatable coating cylinder.

According to this aspect of the invention, since a state is maintained in which the blade makes contact with a uniform pressure in terms of the axial direction of the coating cylinder, it is possible to reduce application non-uniformities in terms of the axial direction of the coating cylinder. As a result of this, decline in the performance of scraping off the excess application liquid is prevented and a film of application liquid having a uniform thickness can be applied to the base member.

Desirably, of the plurality of biasing devices, the biasing devices disposed at end portions of the rotatable coating cylinder in the axial direction have greater biasing force than the biasing devices other than the biasing devices disposed at the end portions of the rotatable coating cylinder.

According to this aspect of the invention, even if the excess application liquid is not scraped off completely from the coating cylinder by the blade and the amount of excess application liquid increases at the respective end portions in the axial direction of the coating cylinder, it is still possible to prevent the excess application liquid from infiltrating through the gap between the blade and the coating cylinder against the biasing force of the biasing devices. As a result of this, the performance of scraping off the excess application liquid is made uniform in the axial direction of the coating cylinder and a film of application liquid having a uniform thickness can be applied to the base member.

Desirably, biasing force of the plurality of biasing devices increases in a stepwise fashion in terms of the axial direction from a central portion of the rotatable coating cylinder toward end portions of the rotatable coating cylinder.

According to this aspect of the invention, even if the excess application liquid is not scraped off completely from the coating cylinder by the blade and the amount of excess application liquid increases from the central portion toward the end portions in the axial direction of the coating cylinder, it is still possible to prevent the excess application liquid from infiltrating through the gap between the blade and the coating cylinder against the biasing force of the biasing devices. By this means, the performance of scraping off the excess application liquid is made more uniform in the axial direction of the coating cylinder and a film of application liquid having a uniform thickness can be applied to the base member.

Desirably, the plurality of biasing devices are torsion springs.

In this aspect of the invention, a desirable mode is one in which torsion springs are used as the biasing devices. It is possible to change the biasing force readily by adjusting the number of turns of the torsion spring, the diameter of the spring wire, the external diameter of the spring, or the like. As a result of this, the performance of scraping off the excess application liquid can be made uniform in the axial direction of the coating cylinder and a film of application liquid having a uniform thickness can be applied to the base member.

Desirably, the blade and the rotatable coating cylinder are made of a same material.

According to this aspect of the invention, the blade and the coating cylinder have the same hardness and therefore the wear of the contacting portion between the blade and the coating cylinder is reduced and the difference in the respective rates of wear is made small. As a result of this, the replacement frequency of the blade is reduced and therefore the maintenance costs can be lowered.

In order to attain an object described above, another aspect of the present invention is directed to a liquid application method comprising the steps of: supplying an application liquid onto a circumferential surface of a rotating coating cylinder at a lower portion of the rotating coating cylinder; and scraping off, by a blade, excess liquid of the application liquid which has been supplied to the circumferential surface of the rotating coating cylinder in such a manner that a prescribed amount of the application liquid remains on the circumferential surface of the rotating coating cylinder, and transferring the application liquid on the circumferential surface of the rotating coating cylinder from which the excess liquid has been removed by the blade, onto a base member which has a band shape and is conveyed continuously while making contact with an upper portion of the circumferential surface of the rotating coating cylinder, wherein, while a blade holding body which holds the blade is supported on a supporting shaft and is rotatable in a rotation direction, a plurality of biasing devices are disposed in an axial direction of the rotating coating cylinder and bias the blade holding body in the rotation direction of the blade holding body in such a manner that the blade makes contact with the circumferential surface of the rotating coating cylinder.

According to this aspect of the invention, even if the blade suffers wear during use, since the blade holding body is biased continuously by the plurality of biasing devices disposed in the axial direction of the coating cylinder, in such a manner that the blade makes contact with the circumferential surface of the coating cylinder, then no gap occurs between the blade and the circumferential surface of the coating cylinder, and hence decline in the performance of scraping off excess application liquid is prevented and a film of application liquid of uniform thickness can be applied to the base member. Moreover, the replacement frequency of the blade is reduced and therefore the maintenance costs can be lowered. Furthermore, there is no need to measure the pressure with which the blade makes contact with the coating cylinder whenever there is wear of the blade, and hence maintenance can be simplified.

In order to attain an object described above, another aspect of the present invention is directed to an inkjet recording apparatus comprising: a treatment liquid deposition device which has the liquid application apparatus that deposits a treatment liquid containing an aggregating agent onto an intermediate transfer body forming the base member; an ink droplet ejection device which ejects droplets of ink onto the intermediate transfer body on which the treatment liquid has been deposited by the treatment liquid deposition device in such a manner that the ink is caused to aggregate by the treatment liquid so as to form an ink image on the intermediate transfer body; and a transfer device which transfers the ink image on the intermediate transfer body, onto a recording medium.

This aspect of the invention is suitable for an inkjet recording apparatus of a so-called transfer type in which an ink image is formed by causing two liquids, namely, an ink and a treatment liquid, to react on an intermediate transfer body, and the ink image is then transferred to a recording medium. It is possible to apply a treatment liquid as a film of uniform thickness on the intermediate transfer body, and therefore it is possible to improve the image quality.

In order to attain an object described above, another aspect of the present invention is directed to an inkjet recording method comprising: a treatment liquid deposition step of depositing a treatment liquid containing an aggregating agent by the liquid application method, onto an intermediate transfer body forming the base member; an ink droplet ejection step of ejecting droplets of ink onto the intermediate transfer body on which the treatment liquid has been deposited in the treatment liquid deposition step in such a manner that the ink is caused to aggregate by the treatment liquid so as to form an ink image on the intermediate transfer body; and a transfer step of transferring the ink image on the intermediate transfer body onto a recording medium.

This aspect of the invention is suitable for an inkjet recording method of a so-called transfer type in which an ink image is formed by causing two liquids, namely, an ink and a treatment liquid, to react on an intermediate transfer body, and the ink image is then transferred to a recording medium. It is possible to apply a treatment liquid as a film of uniform thickness on the intermediate transfer body, and therefore it is possible to improve the image quality.

According to the present invention, even if the blade suffers wear during use, since the blade holding body is biased continuously by the plurality of biasing devices disposed in the axial direction of the coating cylinder, in such a manner that the blade makes contact with the circumferential surface of the coating cylinder, then no gap occurs between the blade and the circumferential surface of the coating cylinder, and hence decline in the performance of scraping off excess application liquid is prevented and a film of application liquid of uniform thickness can be applied to the base member. Moreover, the replacement frequency of the blade is reduced and therefore the maintenance costs can be lowered. Furthermore, there is no need to measure the pressure with which the blade makes contact with the coating cylinder whenever there is wear of the blade, and hence maintenance can be simplified.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Here, an example is described in which a liquid application apparatus according to embodiments of the present invention is applied to an inkjet recording apparatus.

Figure 1:
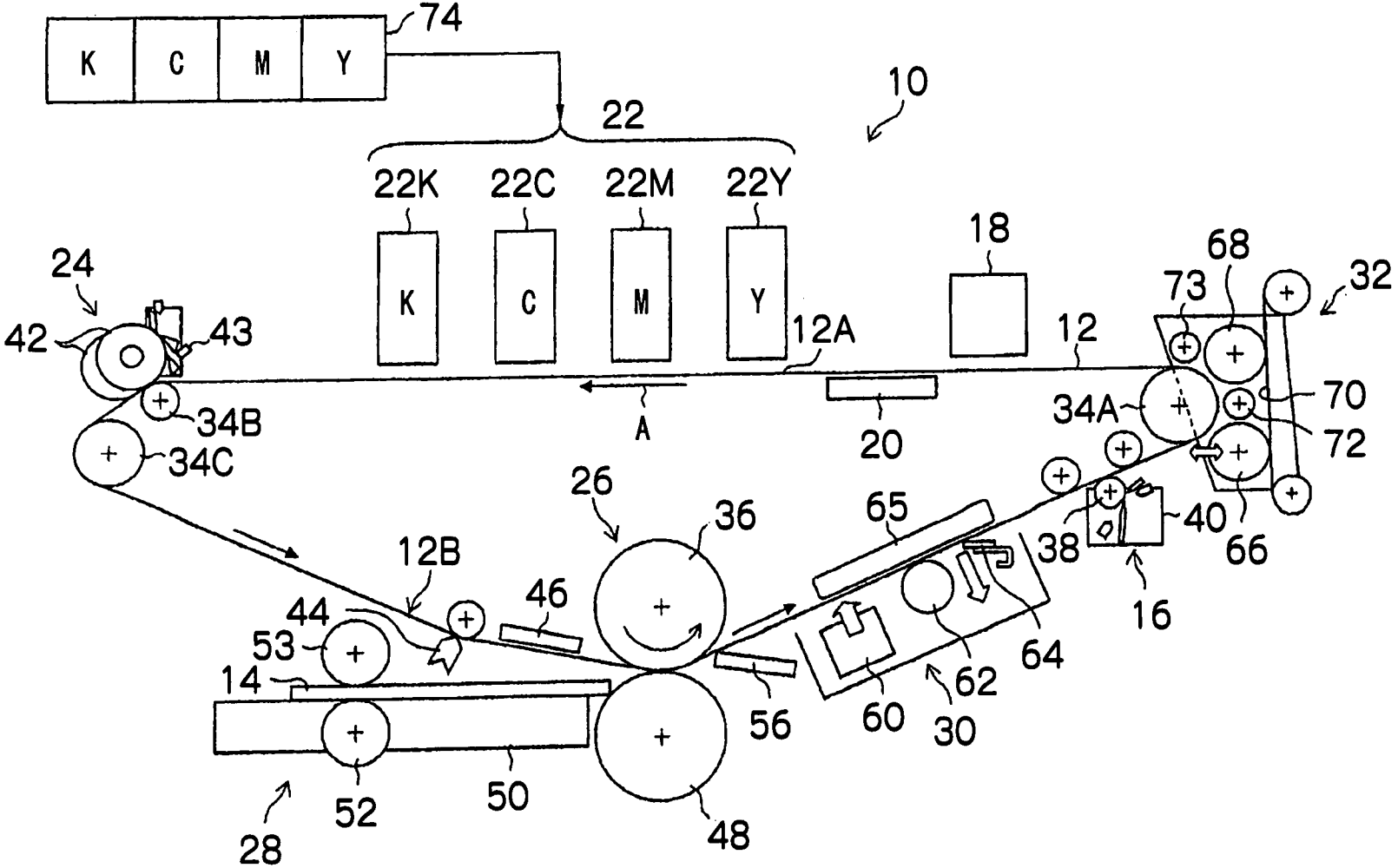
FIG. 1 is a general schematic drawing of an inkjet recording apparatus relating to a first embodiment of the present invention.

General Composition of Inkjet Recording Apparatus Relating to First Embodiment of the Present Invention FIG. 1 is a diagram of the general composition of an inkjet recording apparatus relating to a first embodiment of the present invention.

As shown in FIG. 1, the inkjet recording apparatus 10 according to the present embodiment is a recording apparatus which employs a transfer method in which an image (primary image) is recorded onto an intermediate transfer body 12 (base member) which is a non-permeable medium, and is then transferred to a recording medium 14 such as normal paper, to form a main image (secondary image).

The inkjet recording apparatus 10 principally comprises a treatment liquid application unit 16 (corresponding to a portion where the "liquid application apparatus" according to the present invention is applied) which applies an aggregating treatment liquid (hereinafter, also simply called a "treatment liquid" in the present embodiment) to the intermediate transfer body 12; a heating unit 18 and a cooler 20 for drying and cooling the treatment liquid which has been deposited on the intermediate transfer body 12; a print unit (ink droplet ejection unit) 22 which deposits inks of a plurality of colors onto the intermediate transfer body 12; a solvent removal unit 24 which removes liquid solvent (excess solvent) on the intermediate transfer body 12 after ejection of ink droplets; a transfer unit 26 which transfers the ink image formed on the intermediate transfer body 12, onto a recording medium 14; a paper supply unit 28 which supplies a recording medium 14 to the transfer unit 26; and cleaning units (a first cleaning unit 30 and a second cleaning unit 32) which cleans the intermediate transfer body 12 after transfer.

The composition of the treatment liquid and the ink used in the present example are described in detail hereinafter, but the treatment liquid is an acidic liquid which has the action of aggregating the coloring material which is contained in the ink. The inks are colored inks which contain a coloring material (pigment) of the respective colors of cyan (C), magenta (M), yellow (Y) and black (K).

An endless belt is used for the intermediate transfer body 12. This intermediate transfer body (endless belt) 12 has a structure whereby it is wound about a plurality of rollers (three tensioning rollers 34A to 34C and a transfer roller 36 are depicted in FIG. 1, but the winding mode of the belt is not limited to this example), and the drive power of a motor (not shown in FIG. 1 and indicated by reference numeral 288 in FIG. 13) is transmitted to at least one of the tensioning rollers 34A to 34C or the transfer roller 36, thereby driving the intermediate transfer body 12 in a counter-clockwise direction in FIG. 1 (the direction indicated by the arrow A). The tensioning roller indicated by reference numeral 34C is a tensioner which serves to correct skewed travel of the belt and to apply tension to the belt.

The intermediate transfer body 12 is made of resin, metal, rubber, or the like, which has non-permeable properties that prevent permeation of liquid droplets of ink, in at least the image forming region (not illustrated) where the primary image is formed, of the surface opposing the print unit 22 (the image forming surface) 12A. Furthermore, at least the image forming region of the intermediate transfer body 12 is composed so as to have a horizontal surface (flat surface) which has a prescribed flatness.

Desirable materials for use as the surface layer which includes the image forming surface 12A of the intermediate transfer body 12 are, for example, commonly known materials such as: a polyimide resin, a silicon resin, a polyurethane resin, a polyester resin, a polystyrene resin, a polyolefin resin, a polybutadiene resin, a polyamide resin, a polyvinyl chloride resin, a polyethylene resin, a fluorine resin, and the like.

The surface tension of the surface layer of the intermediate transfer body 12 is desirably set to be equal to or greater than 10 mN/m and equal to or less than 40 mN/m. If the surface tension of the surface layer of the intermediate transfer body 12 is equal to or greater than 40 mN/m, then the surface tension differential with respect to the recording medium 14 onto which the primary image is to be transferred disappears (or becomes extremely low), and the transfer properties of the ink aggregating body worsen. Moreover, if the surface tension of the surface layer of the intermediate transfer body 12 is equal to or less than 10 mN/m, then if the wetting properties of the treatment liquid are taken into account, it is necessary to set the surface tension of the treatment liquid to be lower than the surface tension of the surface layer on the intermediate transfer body 12, and since it is difficult to make the surface tension of the treatment liquid equal to or less than 10 mN/m, then the design freedom (range of selection) of the intermediate transfer body 12 and the treatment liquid is restricted.

From the viewpoint of the durability and transfer characteristics onto normal paper, the intermediate transfer body 12 according to the present embodiment is desirably a body in which an elastic material having a surface energy approximately of 15 to 30 mN/m (=mJ/m$^2$), has been deposited to a thickness of approximately 30 to 150 μm on the base member, such as polyimide, and it is appropriate to provide a coating of silicone rubber, fluorine rubber, a fluorine elastomer, or the like.

The treatment liquid application unit 16 applies a treatment liquid (aggregating treatment agent) which forms an undercoating liquid onto the intermediate transfer body 12 after a cleaning step by the first cleaning unit 30, and the liquid application apparatus according to the present invention corresponds to this treatment liquid application unit 16. The treatment liquid application unit 16 according to the present embodiment applies treatment liquid to the image forming surface 12A of the intermediate transfer body 12 by rotating a gravure roller 38 (which corresponds to the coating cylinder) coated with treatment liquid in the opposite direction to the direction of conveyance of the intermediate transfer body 12 while making contact with the intermediate transfer body 12, and the detailed structure thereof is described hereinafter.

Furthermore, a desirable mode is one where the treatment liquid contains 1 to 5 wt % of polymer resin (micro-particles) with an object of enhancing the coloring material fixing properties and transfer characteristics when depositing droplets of ink. Moreover, it is desirable that the treatment liquid should include a fluorine-type surfactant at a ratio of several percent.

The heating unit 18 is disposed to the downstream side of the treatment liquid application unit 16 and to the upstream side of the print unit 22. The heating unit 18 according to the present example uses a heater whose temperature can be controlled in a range of 50 to 100° C. The treatment liquid deposited on the intermediate transfer body 12 by means of the treatment liquid application unit 16 is heated by passing through this heating unit 18 and the solvent component evaporates, thereby drying the liquid. Consequently, an aggregating treatment agent layer which is in a solid state or a semi-solid state is formed on the surface of the intermediate transfer body 12 (namely, a thin film layer in which the treatment liquid has dried).

The "aggregating treatment agent layer in a solid state or a semi-solid state" referred to here includes a layer having a water content ratio of 0 to 70% as defined below.

"Water content ratio"="Weight per unit surface area of water contained in treatment liquid after drying (g/m$^2$)"/"Weight per unit surface area of treatment liquid after drying (g/m$^2$)" Expression 1

A cooler 20 is disposed on the downstream side of the heating unit 18 in the conveyance direction of the intermediate transfer body, and to the upstream side of print unit 22. This cooler 20 is disposed on the rear surface side of the intermediate transfer body 12. The cooler 20 can be controlled within a prescribed temperature range, and in the present embodiment, for example, it is controlled to 40° C. By cooling the intermediate transfer body 12 on which the aggregating treatment agent layer has been formed by heating and drying by the heating unit 18, to approximately 40° C. by means of the cooler 20, the radiated heat from the intermediate transfer body 12 is reduced, and the drying of the ink in the nozzles of the head in the print unit 22 is suppressed.

The print unit 22 disposed after the cooler 20 comprises liquid ejection heads (hereinafter, called "heads") 22Y, 22M, 22C, 22K of an inkjet type which correspond to the respective ink colors of yellow (Y), magenta (M), cyan (C) and black (K).

The pigment-based inks of respective colors (Y, M, C, K) are ejected from the respective heads 22Y, 22M, 22C and 22K of the print unit 22 onto the aggregating treatment agent layer on the intermediate transfer body 12 which has passed through the cooler 20, in accordance with the image signals, thereby depositing droplets of the inks onto the aggregating treatment agent layer. In the case of the present example, the ink ejection volume achieved by the respective heads 22Y, 22M, 22C and 22K is approximately 2 pl, and the recording density is 1200 dpi in both the main scanning direction (the breadthways direction of the intermediate transfer body 12) and the sub-scanning direction (the conveyance direction of the intermediate transfer body 12). The ink can also contain a polymer resin (micro-particles) having film forming properties, and in the case of this mode, the abrasion-resistant performance and storage stability are improved in the transfer step and the fixing step.

When ink droplets are deposited onto the aggregating treatment agent layer, then the contact surface between the ink and the aggregating treatment agent layer is a prescribed surface area when the ink lands, due to a balance between the propulsion energy (flight energy) and the surface energy. An aggregating reaction starts immediately after the ink has landed on the aggregating treatment agent, but the aggregating reaction starts from the contact surface between the ink and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink has already aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the intermediate transfer body 12.

As described above, an aggregate of the pigment is formed due to an aggregating reaction of the ink deposited onto the aggregating treatment agent layer, and this aggregate separates from the solvent. The solvent (residual solvent) component which has separated is removed from the intermediate transfer body 12 by a solvent removal roller 42 of the solvent removal unit 24 which is disposed to the downstream side of the print unit 22.

The solvent removal roller 42 used here is desirably a roller which traps liquid in surface grooves (cells) by means of a similar principle to the gravure roller used for application. The liquid captured by the solvent removal roller 42 is removed from the solvent removal roller 42 by means of an air blower or liquid spraying action, or the like.

In this way, in a mode where solvent on the image forming surface 12A of the intermediate transfer body 12 is removed by means of a solvent removal roller 42, since the solvent on the intermediate transfer body 12 is removed appropriately, then there is no transfer of large quantities of solvent (dispersion medium) onto the recording medium 14 in the transfer unit 26. Consequently, even in a case where normal paper, or the like, is used as the recording medium 14, it is possible to prevent problems which are characteristic of water-based solvents, such as curling, cockling, or the like.

Moreover, by removing excess solvent from the ink aggregate by means of the solvent removal unit 24, the ink aggregate is condensed and the internal aggregating force is enhanced yet further. Consequently, fusion of the resin particles contained in the ink aggregate is promoted effectively, and a stronger internal aggregating force can be applied to the ink aggregate, up until the transfer step carried out by the transfer unit 26. Moreover, by achieving effective condensation of the ink aggregate by removal of the solvent, it is possible to apply good fixing properties and good luster to the image, even after transfer of the image to the recording medium 14.

It is not absolutely necessary to remove all of the solvent on the intermediate transfer body 12 by means of this solvent removal unit 24. If the ink aggregate is condensed excessively by removing an excessive amount of solvent, then the aggregating force between the ink aggregate and the transfer body becomes too strong, and therefore a very large pressure is needed for transfer, which is not desirable. Rather, in order to maintain a ductility (viscoelasticity) which is suitable for transfer, it is desirable to leave a small amount of solvent.

The following beneficial effects are obtained by leaving a small amount of solvent on the intermediate transfer body 12. Specifically, since the ink aggregate is hydrophobic, and the non-volatile solvent component (principally, the organic solvent, such as glycerine) is hydrophilic, then the ink aggregate and the residual solvent component separate after carrying out solvent removal, and a thin layer of liquid containing the residual solvent component is formed between the ink aggregate and the intermediate transfer body. Consequently, the adhesive force of the ink aggregate on the intermediate transfer body 12 becomes weak, which is beneficial for improving transfer characteristics.

Since the volume of ink ejected as droplets onto the intermediate transfer body 12 varies in accordance with the image contents, then in the case of an image having a large white area (an image having a low ink volume), a mist spray is emitted from a mist spray nozzle 43 in order to supplement this, in such a manner that the amount of water on the intermediate transfer body 12 is stabilized within a prescribed tolerable range.

A soiling determination sensor 44 for determining the soiling of the intermediate transfer body 12, and a pre-heater 46 forming a preliminary heating device are provided to the downstream side of the solvent removal unit 24 and before the transfer unit 26, in terms of the conveyance direction of the intermediate transfer body. The pre-heater 46 according to the present example is disposed on the rear surface 12B side of the intermediate transfer body 12, and hence the intermediate transfer body 12 on which the primary image has been formed is heated from the rear surface 12B side.

The heating temperature range of the pre-heater 46 is 90 to 130° C., and thus it is set to be equal to or greater than the heating temperature of the transfer unit 26 during transfer (in the present example, 90° C.). Since the image formed on the intermediate transfer body 12 is transferred to the recording medium 14 in the transfer unit 26 after preliminarily heating the image forming region of the intermediate transfer body 12, then it is possible to set the heating temperature of the transfer unit 26 to a lower temperature than in a case where preliminary heating is not carried out, and furthermore, it is possible to shorten the transfer time of the transfer unit 26.

The transfer unit 26 is constituted by a transfer roller 36 comprising a heater (not shown in FIG. 1, and indicated by reference numeral 289 which represents a plurality of heaters, in FIG. 13), and a heating roller 48 for creating a heating and pressurization nip, which is disposed opposing the transfer roller 36. In this way, a composition is achieved in which the intermediate transfer body 12 and the recording medium 14 are taken up in between the transfer roller 36 and the pressurization roller 48, and are pressurized at a prescribed pressure (nip pressure) while heating to a prescribed temperature, thereby transferring the primary image formed on the intermediate transfer body 12 to the recording medium 14.

The device for adjusting the nip pressure during transfer in the transfer unit 26 is, for example, a mechanism (drive device) which moves the transfer roller 36 or the pressurization roller 48, or both, in the vertical direction in FIG. 1.

A desirable nip pressure during transfer is 1.5 to 2.0 MPa, and a desirable heating temperature (roller temperature) is 80 to 120° C. In the present example, the transfer roller 36 and the pressurization roller 48 are both set to 90° C. If the heating temperature during transfer by the transfer roller is set too high, then there is a problem of deformation of the intermediate transfer body 12, and the like, whereas if, on the other hand, the heating temperature is too low, then there is a problem of poor transfer characteristics.

Furthermore, if the recording medium 14 is heated in advance (pre-heated) to a temperature of 70 to 100° C. in the paper supply unit 28 before transfer, then the transfer characteristics are further improved, which is desirable. In the case of the present example, a heater 50 is provided in the paper supply unit 28 as a preliminary heating device for the recording medium 14. The recording medium 14 which has been preliminarily heated by the heater 50 is conveyed by the nip of the paper supply rollers formed by the pair of adhesive rollers 52 and 53, and is thereby supplied to the transfer unit 26.

The composition of the paper supply unit 28 may be based on a mode using a magazine of rolled paper (continuous paper), or a mode in which paper is supplied by means of a cassette in which cut paper is stacked and loaded, instead of or in combination with magazine of rolled paper. In the case of a configuration in which roll paper is used, a cutter is provided and the roll paper is cut to a desired size by the cutter. It is also possible to provide a plurality of magazines and cassettes having different paper widths, paper qualities, and the like.

In the case of a configuration in which a plurality of types of recording medium can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

Concrete examples of the recording medium 14 used in the present embodiment are: normal paper (including high-grade paper and recycled paper), permeable media, such as special inkjet paper, non-permeable media, low-permeability media, such as coated paper, sealed paper having adhesive or a detachable label on the rear surface thereof, a resin film, such as an OHP sheet, and a metal sheet, cloth, wood and other types of media.

The recording medium 14 supplied to the transfer unit 26 is heated and pressurized at a prescribed temperature and a prescribed nip pressure by means of the transfer roller 36 and the pressurization roller 48, and the primary image on the intermediate transfer body 12 is transferred onto the recording medium 14. The recording medium 14 (printed object) which has passed through the transfer unit 26 is separated from the intermediate transfer body 12 by means of a separating hook 56, and is output to the exterior of the apparatus by means of a conveyance device (not illustrated). Although not shown in FIG. 1, a sorter which accumulates the printed objects separately according to the print order, is provided in the printed object output unit.

The recording medium 14 (printed object) which has been separated from the intermediate transfer body 12 may undergo a fixing step (not illustrated) before being output from the apparatus. The fixing unit is, for example, constituted by a heating roller pair in which the temperature and pressing force can be adjusted. By adding a fixing step of this kind, the polymer micro-particles contained in the ink create a film (namely, a thin film is formed by the polymer micro-particles fusing on the outermost surface of the image), and therefore the weatherproofing (abrasion resistance) and storage properties are increased yet further. The heating temperature in the fixing step is 100 to 130° C., the pressing force is desirably 2.5 to 3.0 MPa, and these values are optimized in accordance with the temperature characteristics of the added polymer resin (the film forming temperature: MFT), and the like. Of course, since both transfer characteristics and film manufacturing characteristics can be achieved in the transfer step in the transfer unit 26, then it is also possible to adopt a mode in which the fixing unit is omitted.

After the transfer step by the transfer unit 26, the intermediate transfer body 12 which has passed through the detachment unit formed by the separation hook 56 arrives at the first cleaning unit 30.

The first cleaning unit 30 is a device which cleans the intermediate transfer body 12 by using a cleaning liquid obtained by adding a surfactant, or the like, to water, such as distilled water or purified water, or solvent recovered by the solvent removal unit 24, and it is constituted by a cleaning liquid spraying unit 60 which sprays the cleaning liquid, a rotating brush 62 which rotates in a reverse direction with respect to the direction of conveyance of the intermediate transfer body while making contact with the image forming surface 12A of the intermediate transfer body 12, and a blade 64 which slides and wipes the surface of the intermediate transfer body 12. Furthermore, a heater 65 is disposed on the rear surface side of the intermediate transfer body 12 in the first cleaning unit 30. The first cleaning unit 30 principally functions as a device which cleans the intermediate transfer body 12 after completing image transfer to the recording medium 14.

The liquid cleaning step performed by using the cleaning liquid in the first cleaning unit 30 is appropriate for high-speed continuous processing, but a small amount of residual material is liable to remain on the intermediate transfer body 12, and there are limits on the stable cleaning which can be achieved in the edge portions of the intermediate transfer body 12. Consequently, due to the accumulation of residual material with operation over a long period of time, then problems may occur, such as deterioration in the transfer characteristics and sensitivity, soiling of the apparatus, operational defects, and the like.

Alternatively, if hard dust particles, such as grit particles, become attached to the intermediate transfer body due to the inflow of external air used for cooling the interior of the apparatus, the generation of dust inside the apparatus, or the performance of maintenance work or the like, then this dust enters in between the wiping members (the rotating brush 62 and the blade 64) during liquid cleaning by the first cleaning unit 30, and it may give rise to damage, such as scratch marks on the intermediate transfer body 12.

From the viewpoint of responding to problems of this kind, in the present embodiment, a second cleaning unit 32 is provided which uses an adhesive member (adhesive rollers 66 and 68 for removing dust). The second cleaning unit 32 is constituted by adhesive rollers 66 and 68 which can be moved to control the contact state and the separation with respect to the surface 12A of the intermediate transfer body 12, and a cleaning web (or adhesive belt) 70 which is able to make contact with these adhesive rollers 66 and 68. As shown in the drawings, this second cleaning unit 32 is disposed at a position opposing the tensioning roller 34A. In FIG. 1, the reference numerals 72 and 73 are pressing rollers.

Before liquid cleaning, either during standby or another non-image forming state, or during image formation, the adhesive rollers 66 and 68 are rotated while making contact with the intermediate transfer body 12, and therefore the foreign material on the intermediate transfer body 12 becomes attached to the adhesive rollers 66 and 68, thereby removing the foreign material (dust) from the intermediate transfer body and thus cleaning the surface of the intermediate transfer body.

The foreign material which has become attached to the surface of the adhesive rollers 66 and 68 can be moved to the cleaning web (or the adhesive belt) 70, by separating the adhesive rollers 66 and 68 from the intermediate transfer body 12 and rotating the adhesive rollers 66 and 68 in contact with the cleaning web (or adhesive belt) 70. Consequently, it is possible to clean the surface of the adhesive rollers 66 and 68.

Furthermore, the composition of the principal part of the inkjet recording apparatus 10 will be described in more detail.

Compositional Example of Print Unit

As shown in FIG. 1, the print unit 22 comprises heads 22Y, 22M, 22C, 22K corresponding to the respective colors, provided in the sequence of yellow (Y), magenta (M), cyan (C), black (K), from the upstream side following the conveyance direction of the intermediate transfer body.

The ink storing and loading unit 74 is constituted by an ink tank which stores respective ink liquids which are supplied respectively to the heads 22Y, 22M, 22C and 22K. The ink tanks are connected to the respectively corresponding heads, via prescribed flow channels, and hence the respectively corresponding ink liquids are supplied to the respective heads. The ink storing and loading unit 74 comprises a warning device (for example, a display device or an alarm sound generator) for warning when the remaining amount of any liquid in the tank is low, and has a mechanism for preventing loading errors between different colors.

The inks are supplied from the respective ink tanks of the ink storing and loading unit 74 to the respective heads 22Y, 22M, 22C, 22K, and droplets of the respectively corresponding colored inks are ejected respectively onto the image forming surface 12A of the intermediate transfer body 12, from the respective heads 22Y, 22M, 22C and 22K.

Figure 2:
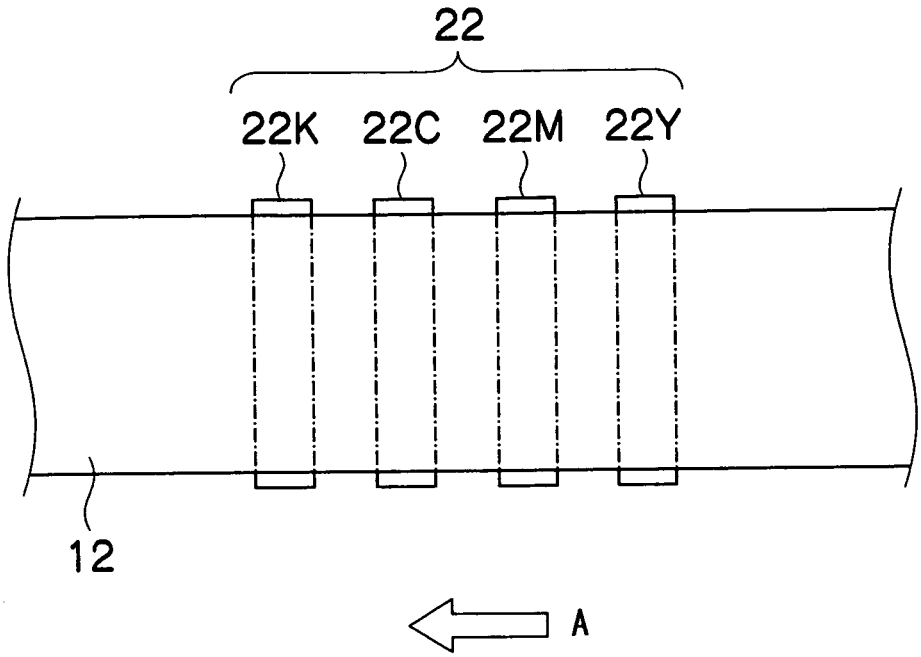
FIG. 2 is a principal plan diagram of the periphery of a print unit.

FIG. 2 shows a plan diagram of the print unit 22. As shown in FIG. 2, the heads 22Y, 22M, 22C, 22K are each formed as full line type heads, which have a length corresponding to the maximum width of the image forming range of the intermediate transfer body 12, and comprises a nozzle row in which a plurality of nozzles for ejecting ink (not shown in FIG. 1, indicated by reference numeral 81 in FIGS. 3A and 3B) are arranged through the full width of the image forming region and provided in the ink ejection surface of the head. The heads 22Y, 22M, 22C and 22K are each disposed in a fixed position so as to extend in the direction perpendicular to the conveyance direction of the intermediate transfer body.

According to a composition where a full line head having a nozzle row covering the whole width of the intermediate transfer body 12 is provided for each type of ejection liquid, it is possible to form an image (primary image) on the image forming region of the intermediate transfer body 12, by performing just one operation of moving the intermediate transfer body 12 and the print unit 22 relatively in the conveyance direction of the intermediate transfer body 12 (the sub-scanning direction), (in other words, by means of one sub-scanning action). Therefore, it is possible to achieve a higher printing speed compared to a case which uses a serial (shuttle) type of head which moves back and forth reciprocally in the direction perpendicular to the conveyance direction of the intermediate transfer body, and hence it is possible to improve the print productivity.

Although a configuration with the four standard colors of C, M, Y and K is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added, and there is no particular restriction on the arrangement sequence of the heads of the respective colors.

Structure of the Head

Next, the structure of each head will be described. The heads 22Y, 22M, 22C and 22K of the respective ink colors have the same structure, and a reference numeral 80 is hereinafter designated to any of the heads.

Figure 3A:
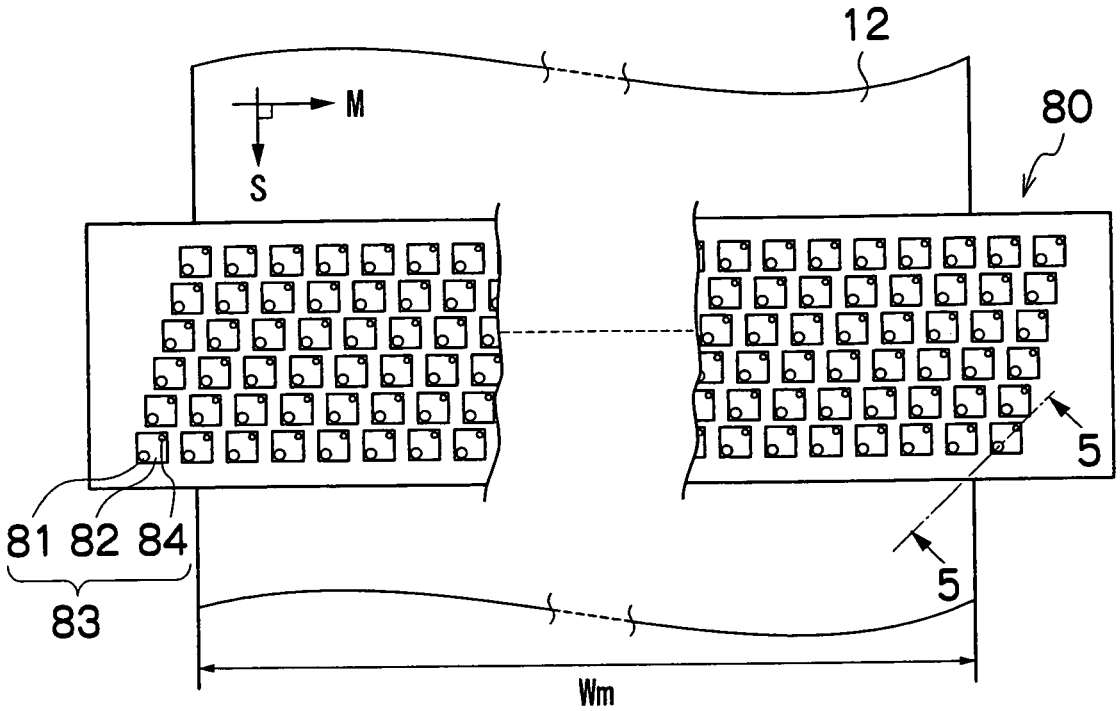
FIGS. 3A and 3B are plan view perspective diagrams showing the internal structure of a head.
Figure 3B:
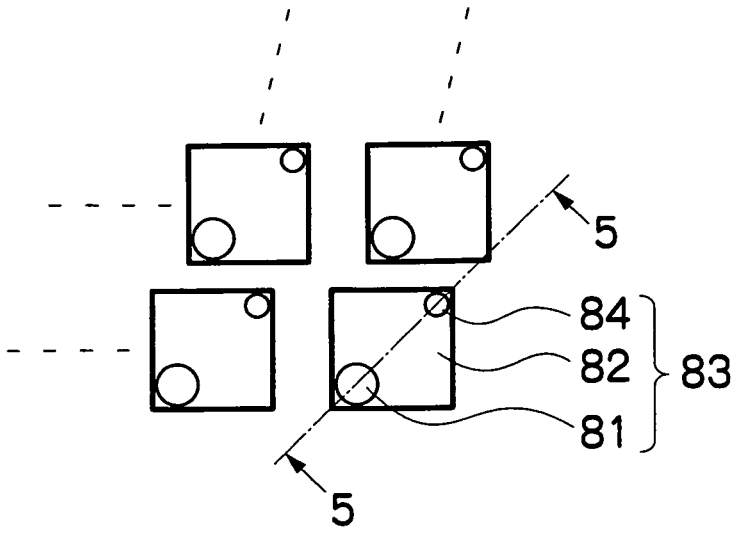

FIG. 3A is a perspective plan view showing an example of the configuration of the head 80, and FIG. 3B is an enlarged view of a portion thereof. The nozzle pitch in the head 80 should be minimized in order to maximize the density of the dots printed on the surface of the intermediate transfer body 12. As shown in FIGS. 3A and 3B, the head 80 according to the present embodiment has a structure in which a plurality of ink chamber units (droplet ejection elements as recording element units) 83, each comprising a nozzle 81 forming an ink ejection port, a pressure chamber 82 corresponding to the nozzle 81, and the like, are disposed two-dimensionally in the form of a staggered matrix, and hence the effective nozzle interval (the projected nozzle pitch) as projected in the lengthwise direction of the head (the direction perpendicular to the paper conveyance direction of the intermediate transfer body 12) is reduced and high nozzle density is achieved.

Figure 4:
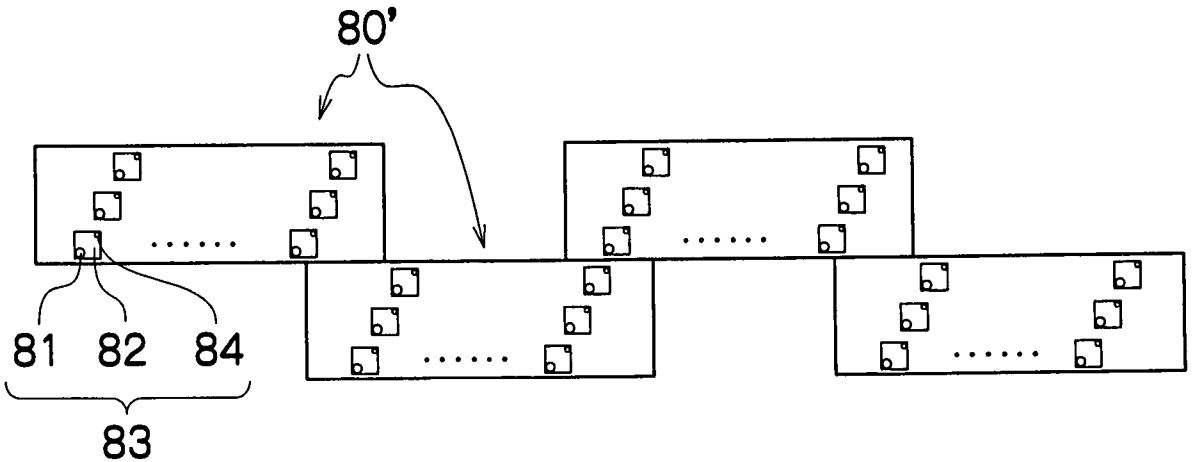
FIG. 4 is a plan diagram showing a further example of the composition of a head.

The mode of composing one or more nozzle rows through a length corresponding to the full width of the image forming region of the intermediate transfer body 12 in the direction substantially perpendicular to conveyance direction (arrow S in FIGS. 3A and 3B) of the intermediate transfer body 12 (in other words, in the direction indicated by arrow M in FIGS. 3A and 3B), is not limited to the example shown in FIGS. 3A and 3B. For example, instead of the composition in FIG. 3A, as shown in FIG. 4, a line head having nozzle rows of a length corresponding to the entire width of the image forming region of the intermediate transfer body 12 can be formed by arranging and combining, in a staggered matrix, short head modules 80' each having a plurality of nozzles 81 arrayed in a two-dimensional fashion.

As shown in FIGS. 3A and 3B, the planar shape of the pressure chamber 82 provided for each nozzle 81 is substantially a square, and an outlet to the nozzle 81 is disposed in one of the two corners on a diagonal line of the square and an inlet of supplied ink (supply port) 84 is disposed in the other corner. The shape of the pressure chamber 82 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 5:
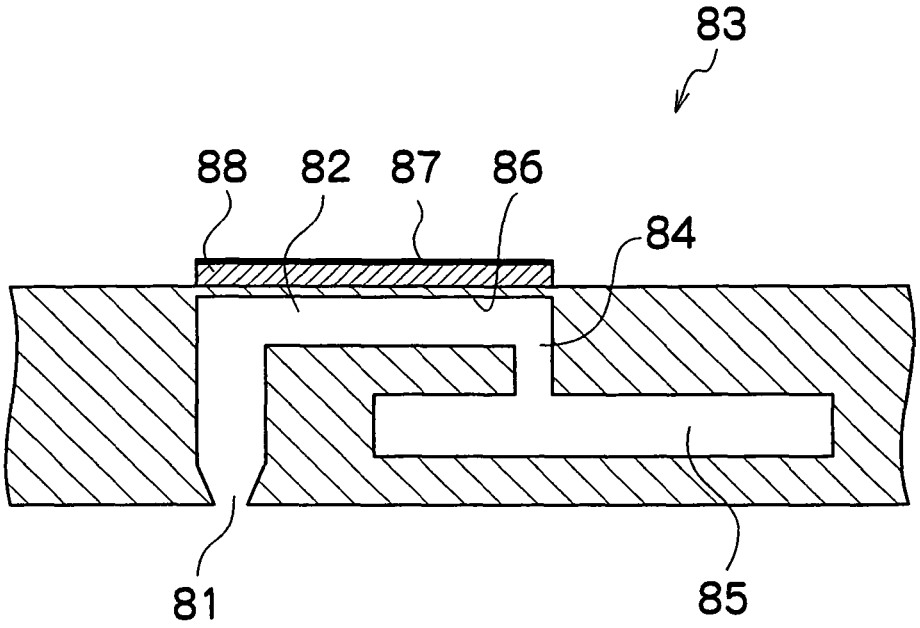
FIG. 5 is a cross-sectional diagram along line 5-5 in FIGS. 3A and 3B.

FIG. 5 is a cross-sectional diagram (along line 5-5 in FIGS. 3A and 3B) showing the composition of the liquid droplet ejection element of one channel which forms a recording element unit in the head 80 (an ink chamber unit corresponding to one nozzle 81).

As shown in FIG. 5, each pressure chamber 82 is connected to a common channel 85 through the supply port 84. The common channel 85 is connected to an ink tank (that is not shown in FIG. 5, but is equivalent to the ink storing and loading unit 74 in FIG. 1), which is a base tank that supplies ink, and the ink supplied from the ink tank is delivered through the common flow channel 85 to the pressure chambers 82.

An actuator 88 provided with an individual electrode 87 is bonded to a pressure plate 86 (a diaphragm that also serves as a common electrode) which forms the surface of a part of the pressure chamber 82 (the ceiling in FIG. 5). When a drive voltage is applied between the individual electrode 87 and the common electrode, the actuator 88 is deformed, the volume of the pressure chamber 82 is thereby changed, and the pressure in the pressure chamber 82 is thereby changed, so that the ink inside the pressure chamber 82 is thus ejected through the nozzle 81. The actuator 88 is preferably a piezoelectric element using a piezoelectric substance such as lead zirconate titanate and barium titanate. When the displacement of the actuator 88 returns to its original position after ejecting ink, the supply port 82 is replenished with new ink from the pressure chamber 85 via the common flow channel 84.

By controlling the driving of the actuators 88 corresponding to the nozzles 81 in accordance with the dot data generated from the input image by a digital half-toning process, it is possible to eject ink droplets from the nozzles 81. By controlling the ink ejection timing from the nozzles 81 in accordance with the speed of conveyance of the intermediate transfer body 12, while conveying the intermediate transfer body 12 in the sub-scanning direction at a uniform speed, it is possible to record a desired image (here, a primary image before transfer) onto the intermediate transfer body 12.

Figure 6:
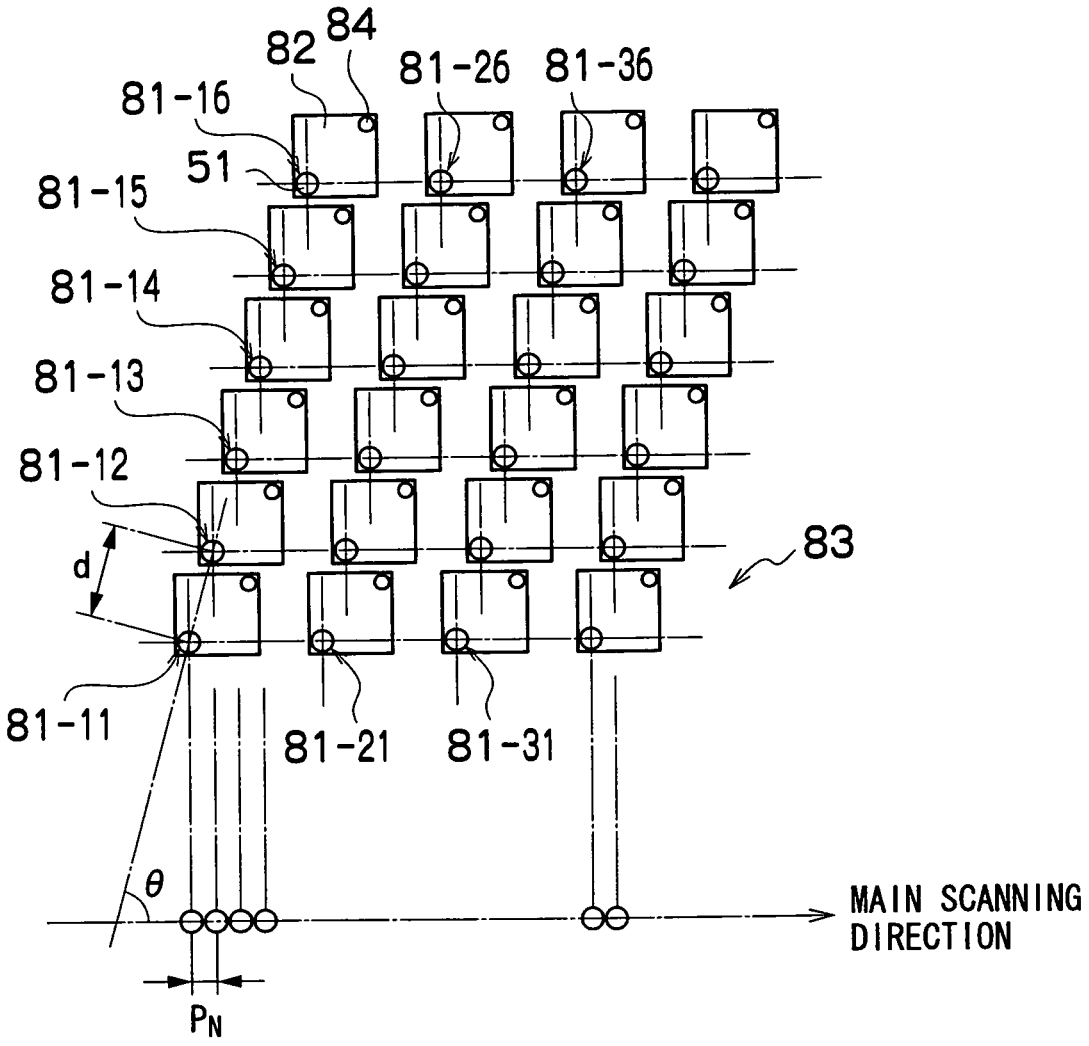
FIG. 6 is a plan diagram showing an example of the arrangement of nozzles in a head.

As shown in FIG. 6, the high-density nozzle head according to the present embodiment is achieved by arranging a plurality of ink chamber units 83 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 83 are arranged at a uniform pitch d in line with a direction forming an angle of θ with respect to the main scanning direction, the pitch P of the nozzles projected (orthographically-projected) so as to align in the main scanning direction is d×cos θ, and hence the nozzles 81 can be regarded to be equivalent to those arranged linearly at a fixed pitch P along the main scanning direction. Such configuration results in a substantial high density of nozzle rows projected so as to align in the main scanning direction.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the intermediate transfer body 12 (the direction perpendicular to the conveyance direction of the intermediate transfer body 12) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 81 arranged in a matrix such as that shown in FIG. 6 are driven, the main scanning according to the above-described (3) is preferred. More specifically, the nozzles 81-11, 81-12, 81-13, 81-14, 81-15 and 81-16 are treated as a block (additionally; the nozzles 81-21, 81-22, . . . , 81-26 are treated as another block; the nozzles 81-31, 81-32, . . . , 81-36 are treated as another block; . . . ); and one line is printed in the width direction of the intermediate transfer body 12 by sequentially driving the nozzles 81-11, 81-12, . . . , 81-16 in accordance with the conveyance velocity of the intermediate transfer body 12.

On the other hand, "sub-scanning" is defined as to repeatedly perform printing of one line (a line formed of a row of dots, or a line formed of a plurality of rows of dots) formed by the main scanning, while moving the full-line head and the intermediate transfer body 12 relatively to each other.

The direction indicated by one line (or the lengthwise direction of a band-shaped region) recorded by the main scanning as described above is called the "main scanning direction", and the direction in which sub-scanning is performed, is called the "sub-scanning direction". In other words, in the present embodiment, the conveyance direction of the intermediate transfer body 12 is called the sub-scanning direction and the direction perpendicular to same is called the main scanning direction. In implementing the present invention, the arrangement of the nozzles is not limited to that of the example illustrated.

Moreover, a method is employed in the present embodiment where an ink droplet is ejected by means of the deformation of the actuator 88, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Preparation of Aggregating Treatment Agent

Treatment Liquid Example 1

A treatment liquid (Example 1) was prepared according to the composition shown in Table 1. Thereupon, the physical properties of the treatment liquid (Example 1) thus obtained were measured, and the pH was 3.6, the surface tension was 28.0 mN/m, and the viscosity was 3.1 mPa·s.

TABLE 1

| Material | Weight % |
|---|---|
| 2-pyrrolidone-5-carboxylic acid (made by Tokyo Chemical Industry Co., Ltd.) | 10 |
| Lithium hydroxide - hydride (made by Wako Pure Chemical Industries, Ltd.) | 2 |
| Olfine E1010 (made by Nissin Chemical Industry Co., Ltd.) | 1 |
| Ion-exchanged water (Deionized water) | 87 |

Treatment Liquid Example 2

A treatment liquid containing added surfactant having the composition shown in Table 2 was prepared (Example 2). Thereupon, the physical properties of the treatment liquid (Example 2) thus obtained were measured, and the pH was 3.5, the surface tension was 18.0 mN/m, and the viscosity was 10.1 mPa·s.

TABLE 2

| Material | Weight % |
|---|---|
| 2-pyrrolidone-5-carboxylic acid (made by Tokyo Chemical Industry Co., Ltd.) | 10 |
| Lithium hydroxide - hydride (made by Wako Pure Chemical Industries, Ltd.) | 2 |
| Olfine E1010 (made by Nissin Chemical Industry Co., Ltd.) | 1 |
| Fluorine surfactant 1 | 3 |
| Ion-exchanged water | 84 |

The chemical formula of the fluorine surfactant 1 used in Table 2 is shown as follows.

Chemical formula 1

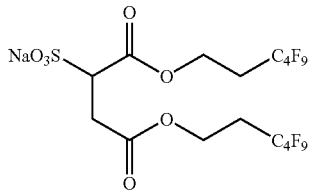

Preparation of Ink

An example of the preparation of an ink used in the present embodiment is described below.

Preparation of (Polymer Dispersion) Cyan Ink

A solution comprising 6 parts by weight of styrene, 11 parts by weight of stearyl methacrylate, 4 parts by weight of styrene macromer AS-6 (made by To a Gosei Co., Ltd.), 5 parts by weight of "Premmer" PP-500 (made by NOF Corp.), 5 parts by weight of methacrylic acid, 0.05 parts by weight of 2-mercapto ethanol, and 24 parts by weight of methylethyl ketone was prepared in a reaction vessel.

On the other hand, a mixed solution was prepared by introducing, into a titration funnel, 14 parts by weight of styrene, 24 parts by weight of stearyl methacrylate, 9 parts by weight of styrene macromer AS-6 (made by To a Gosei Co., Ltd.), 9 parts by weight of "Premmer" PP-500 (made by NOF Corp.), 10 parts by weight of methacrylic acid, 0.13 parts by weight of 2-mercapotoethanol, 56 parts by weight of methylethyl ketone, and 1.2 parts by weight of 2,2'-azobis(2,4-dimethyl valeronitrile).

Thereupon, the mixed solution inside the reaction vessel was raised to a temperature of 75° C. while being agitated, in a nitrogen atmosphere, and the mixed solution in the titration funnel was gradually added by titration over a period of one hour. When two hours had passed after the end of titration, a solution obtained by dissolving 1.2 parts by weight of 2,2'-azobis (2,4-dimethyl valeronitrile) in 12 parts by weight of methylethyl ketone was added by titration over a period of 3 hours, and the mixture was matured for a further two hours at 75° C. and two hours at 80° C., thereby yielding a polymer dispersant solution.

A portion of the polymer dispersant solution thus obtained was separated by removing the solvent, and the resulting solid component was diluted to 0.1 wt % with tetrahydrofuran, and then measured with a high-speed GPC (gel permeation chromatography) apparatus HLC-8220GPC, using three sequential columns: TSKgel Super HZM-H, TSKgel Super HZ4000, and TSKgel Super HZ2000. The weight-average molecular weight was 25,000, when indicated as the weight of a polystyrene molecule.

5.0 g, by solid conversion, of the obtained polymer dispersant, 10.0 g of the cyan pigment, Pigment Blue 15:3 (made by Dainichiseika Color & Chemicals Mfg. Co., Ltd.), 40.0 g of methylethyl ketone, 8.0 g of 1 mol/L sodium hydroxide, 82.0 g of ion-exchanged water, and 300 g of 0.1 mm zirconia beads were supplied to a vessel, and dispersed for 6 hours at 1000 rpm in a "Ready Mill" dispersion machine (made by IMEX Co., Ltd.). The dispersion thus obtained was condensed at reduced pressure in an evaporator until the methyl ethyl ketone had been sufficiently removed, and the pigment density become 10%. The pigment particle size of the cyan dispersion liquid thus obtained was 77 mm.

Using this cyan dispersion, an ink was prepared to achieve the composition shown in Table 3, and the prepared ink was then passed through a 5 μm filter to remove coarse particles, thereby obtaining a cyan ink (C1-1). Thereupon, the physical properties of the cyan ink C1-1 thus obtained were measured, and the pH was 9.0, the surface tension was 32.9 mN/m, and the viscosity was 3.9 mPa·s.

TABLE 3

| Material | Weight % |
|---|---|
| Cyan pigment (Pigment Blue 15:3) (made by Dainichiseika Color & Chemicals Mfg. Co., Ltd.) | 4 |
| Polymer dispersant | 2 |
| Latex LX-2 | 8 |
| Glycerine (made by Wako Pure Chemical Industries, Ltd.) | 20 |
| Diethylene glycol (made by Wako Pure Chemical Industries, Ltd.) | 10 |
| Olfine E1010 (made by Nissin Chemical Industry Co., Ltd.) | 1 |
| Ion-exchanged water | 65 |

Magenta, yellow and black inks were also prepared in a similar fashion to the above.

Additional Polymer

Particles of a polymer resin, or the like, are added to the treatment liquid (aggregating treatment liquid) and ink described above, as appropriate. In the treatment liquid, it is desirable to introduce particles having a particle size of 1 to 5 μm and a melting point of 60 to 120° C., in order to stabilize the coloring material and improve transfer performance, whereas in the ink, it is desirable to introduce particles having a particle size of 1 μm or less and a glass transition point of 40 to 60° C., at a ratio of 1 to 5%, in order to fix the image. An example is shown in Table 4.

TABLE 4

| Category | Composition | Particle diameter (μm) | Tg (° C.) | MFT (° C.) | Tm (° C.) |
|---|---|---|---|---|---|
| Aggregating treatment agent (LX-1) | Low-molecular-weight ethylene | 4 | — | — | 110 |
| | Low-molecular-weight ethylene | 1 | — | — | 110 |
| | Paraffin wax | 0.3 | — | — | 66 |
| Ink (LX-2) | Acrylic | 0.12 | 47 | 65 | — |
| | Styrene acrylic | 0.07 | 49 | 46 | — |

Tg: glass transition point; Tm: melting point

Composition of Treatment Liquid Application Unit

First Example of Liquid Application Apparatus

A liquid application apparatus 100 according to the present embodiment can be used in an application method in which the treatment liquid which has been taken up from a liquid receiving pan by rotating the coating cylinder is regulated to a prescribed application amount by a blade and is then applied to the intermediate transfer body 12 (base member). In the following description, the liquid application apparatus 100 is described in an example of a direct gravure coater method which uses a gravure roller as the coating cylinder.

Figure 7:
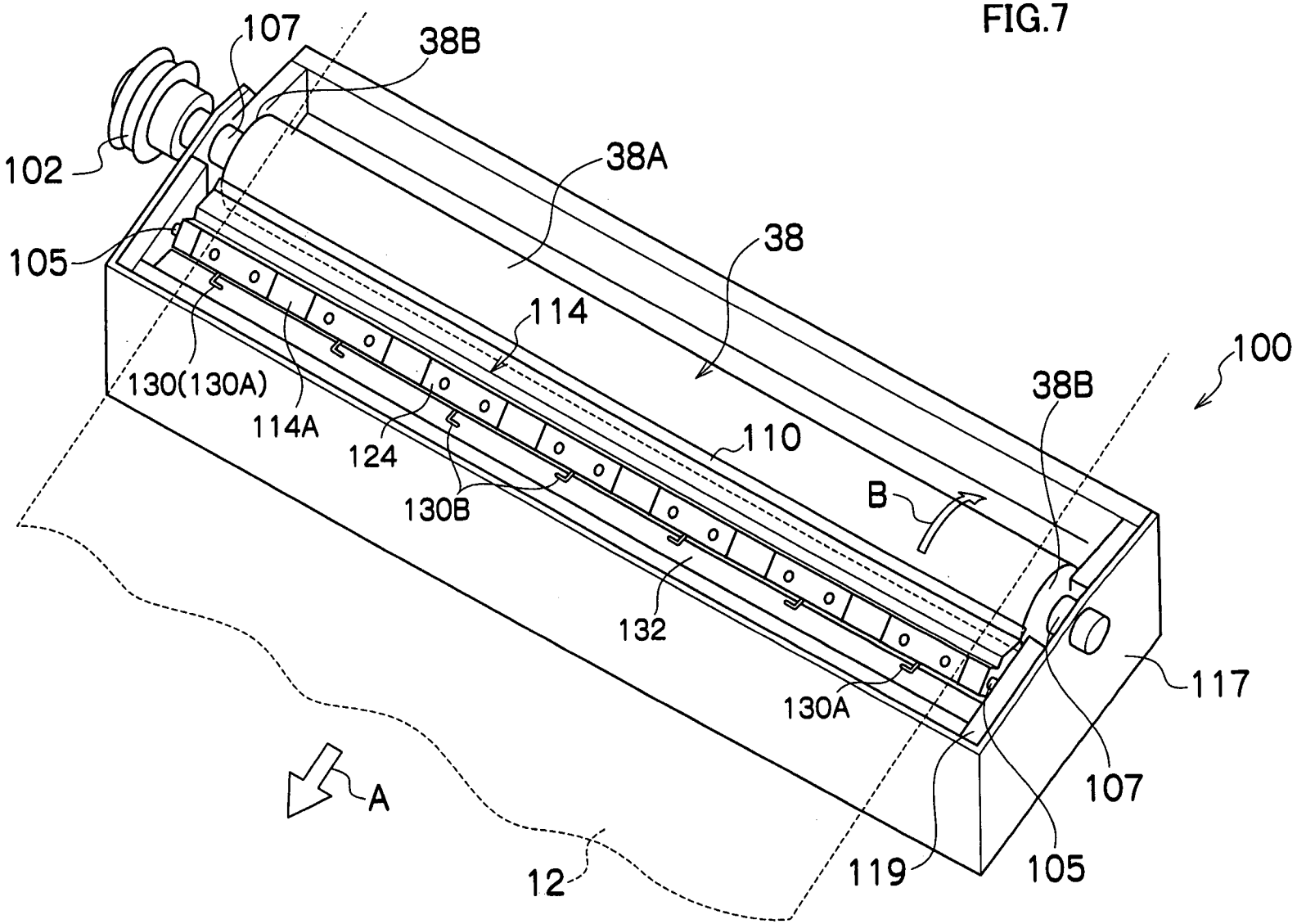
FIG. 7 is an oblique diagram showing a first example of a liquid application apparatus used in a treatment liquid application unit.
Figure 8:
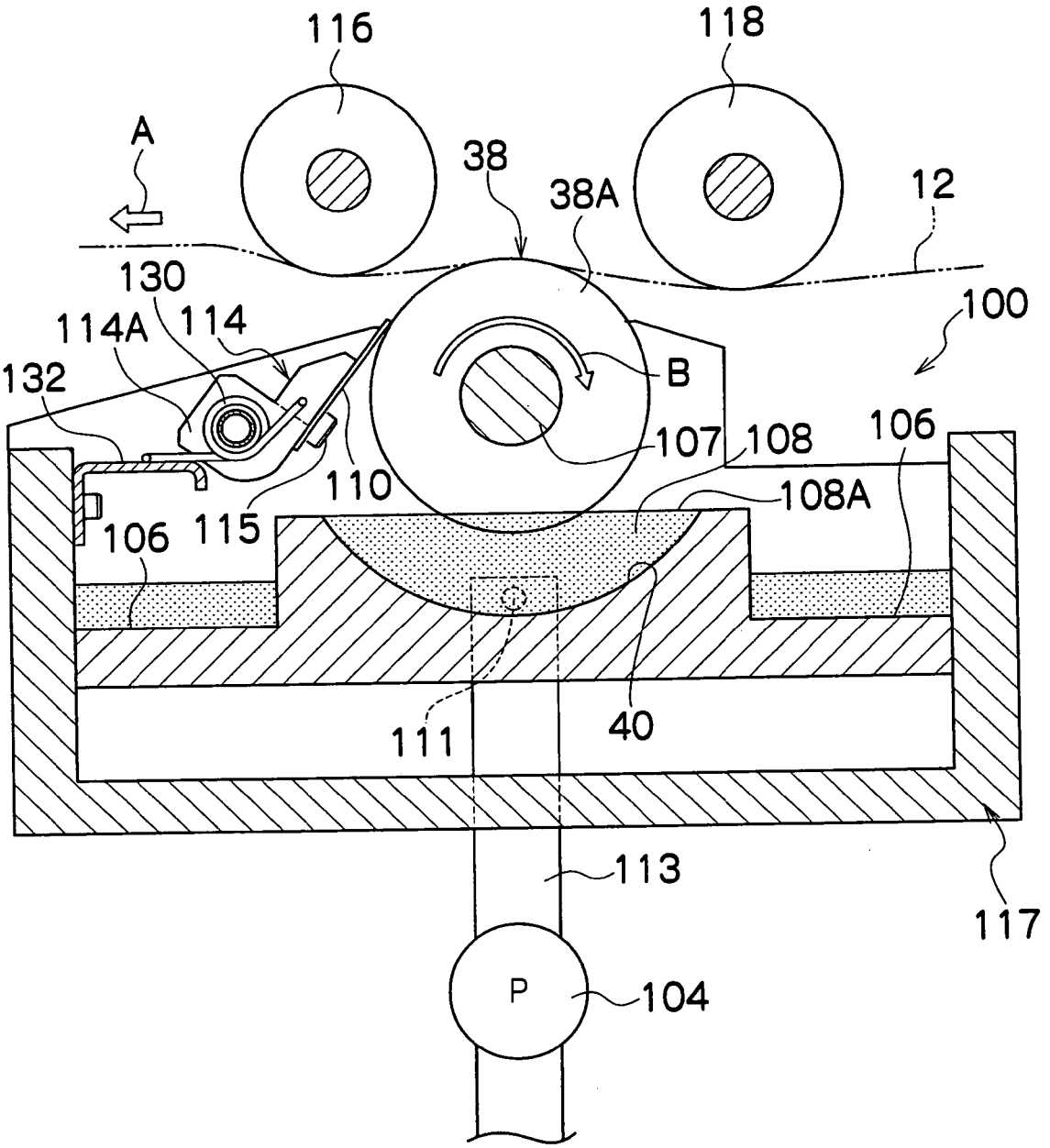
FIG. 8 is a side view cross-sectional diagram of a liquid application apparatus.

FIG. 7 is an overall perspective diagram of the liquid application apparatus 100 as viewed from an upper oblique direction, and FIG. 8 is a side cross-sectional diagram of FIG. 7. In FIG. 7 and FIG. 8, the intermediate transfer body 12 is conveyed in the direction of arrow A. As shown in these diagrams, in the liquid application apparatus 100, the upper end circumferential surface of the application portion 38A of the gravure roller 38 makes contact with the band-shaped intermediate transfer body 12 which is conveyed in a continuous fashion, and the lower end portion of the application section 38A is immersed in the treatment liquid 108 inside the liquid receiving pan 40. As shown in FIG. 8, the treatment liquid 108 is supplied to the liquid receiving pan 40 from a supply port 111, via a treatment liquid channel 113, by means of a liquid supply pump 104. Overflow receiving sections 106, 106 are provided on the upstream side and downstream side of the liquid receiving pan 40 (in terms of the direction of conveyance of the intermediate transfer body 12), and the treatment liquid which is supplied continuously from the supply port 111 flows over into the overflow receiving sections 106 from the liquid receiving pan 40. Furthermore, the treatment liquid 108 which has overflowed into the overflow receiving sections 106, 106 is recycled back to the liquid receiving pan 40 by means of a circulation system (pump, pipes, etc.) which is not illustrated. By this means, the liquid surface inside the liquid receiving pan 40 is kept to the overflow surface at all times, and the height of the surface of the treatment liquid 108 is kept uniform. Reference numeral 108A in FIG. 8 denotes the liquid surface when the gravure roller 38 is not being rotated.

The gravure roller 38 is driven to rotate at a uniform speed in the direction B in FIG. 7 and FIG. 8 (the opposite direction to the direction of conveyance of the intermediate transfer body 12) by means of the rotational driving force of a motor (not illustrated) being transmitted to the gravure roller 38 via a drive pulley 102. The treatment liquid 108 in the liquid receiving pan 40 is taken up and adheres to the circumferential surface of the gravure roller 38. The excess amount of the treatment liquid 108 adhering to the circumferential surface of the gravure roller 38 is scraped off to achieve a prescribed application amount by a blade 110, and the treatment liquid 108 of the regulated amount on the circumferential surface of the gravure roller 38 is transferred and applied onto the lower surface of the intermediate transfer body 12 by means of the gravure roller 38 making contact with the intermediate transfer body 12.

A desirable mode is one in which the rotational drive device for the gravure roller 38 (not illustrated) uses direct drive by an inverter motor (direct shaft coupling), but it is not limited to this mode, and it is also possible to use a combination of various types of motor and a reduction gear device, or a combination of various types of motor and a wound transmission device, such as a timing belt.

Moreover, the gravure roller 38 is supported movably in the vertical direction by means of a movement mechanism (abutment/separation mechanism), which is not illustrated, and therefore it can be controlled and switched between a state where the gravure roller 38 is pressed against the intermediate transfer body 12, and a state where it has been separated (retracted) from the intermediate transfer body 12.

The gravure roller 38 comprises a cylindrical application section 38A which makes contact with the blade 110, and a rotational shaft 107 of the gravure roller 38 is provided on either side of the application section 38A. The diameter of the rotational shaft 107 is formed to be smaller than the diameter of the application section 38A. Desirably, the diameter ϕ of the application section 38A is 40 mm or less and more desirably, 30 mm or less, in order to be able to apply a thin film of the treatment liquid 108 and to compactify the apparatus. In other words, it is desirable that the application section 38A should be of markedly smaller diameter than the diameter of approximately 50 to 80 mm of a gravure roller which is used in a general gravure printing apparatus or gravure application apparatus, etc. In this case, the lower limit of the diameter ϕ of the application section 38A is desirably set to approximately 30 mm in order to prevent warping of the gravure roller 38. If the diameter ϕ of the application section 38A is set to the range described above, then desirably the amount of immersion by which the lower end portion of the application section 38A is immersed in the treatment liquid 108 in the liquid receiving pan 40 is set to a range of 1 to 4 mm, and more desirably, a range of 2 to 3 mm.

Figure 9A:
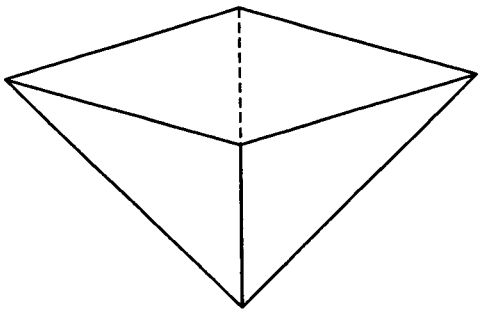
FIGS. 9A and 9B are diagrams showing examples of the state of a cell formed on the surface of a gravure roller.
Figure 9B:
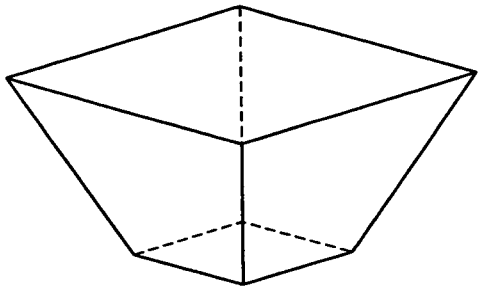
Figure 10:
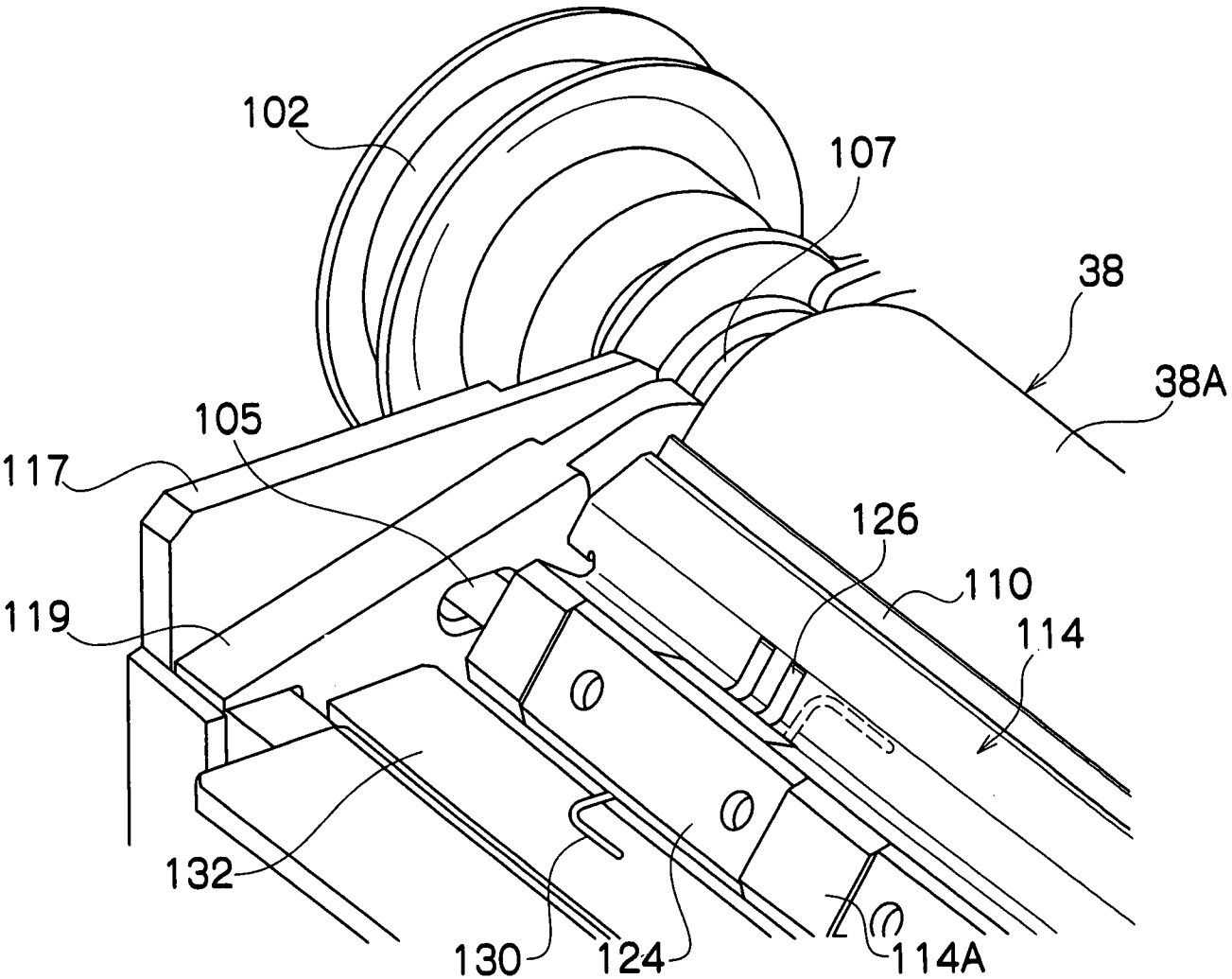
FIG. 10 is an illustrative diagram for describing a blade bracket of a liquid application apparatus.
Figure 11:
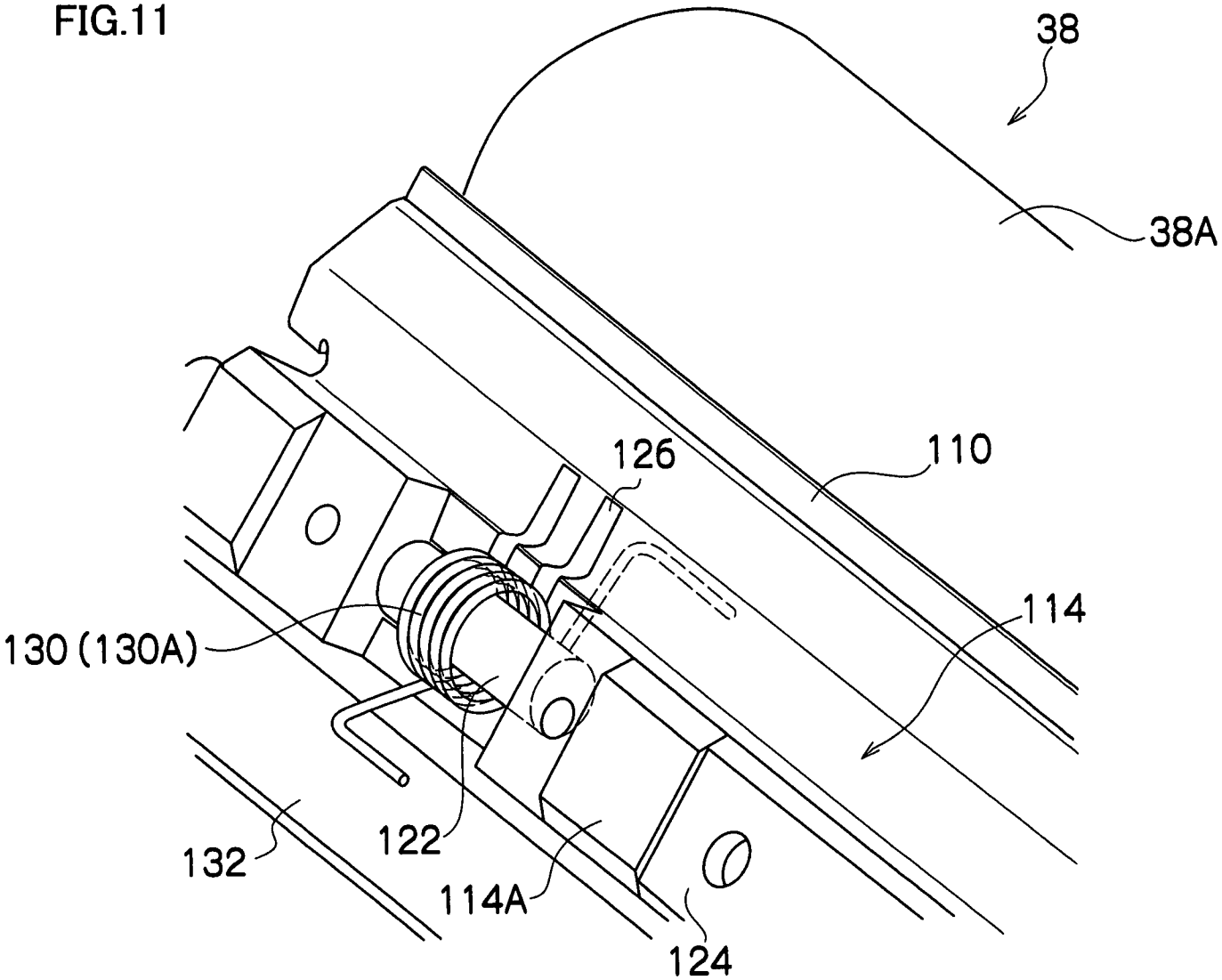
FIG. 11 is an illustrative diagram for describing a torsion spring of a liquid application apparatus.
Figure 12:
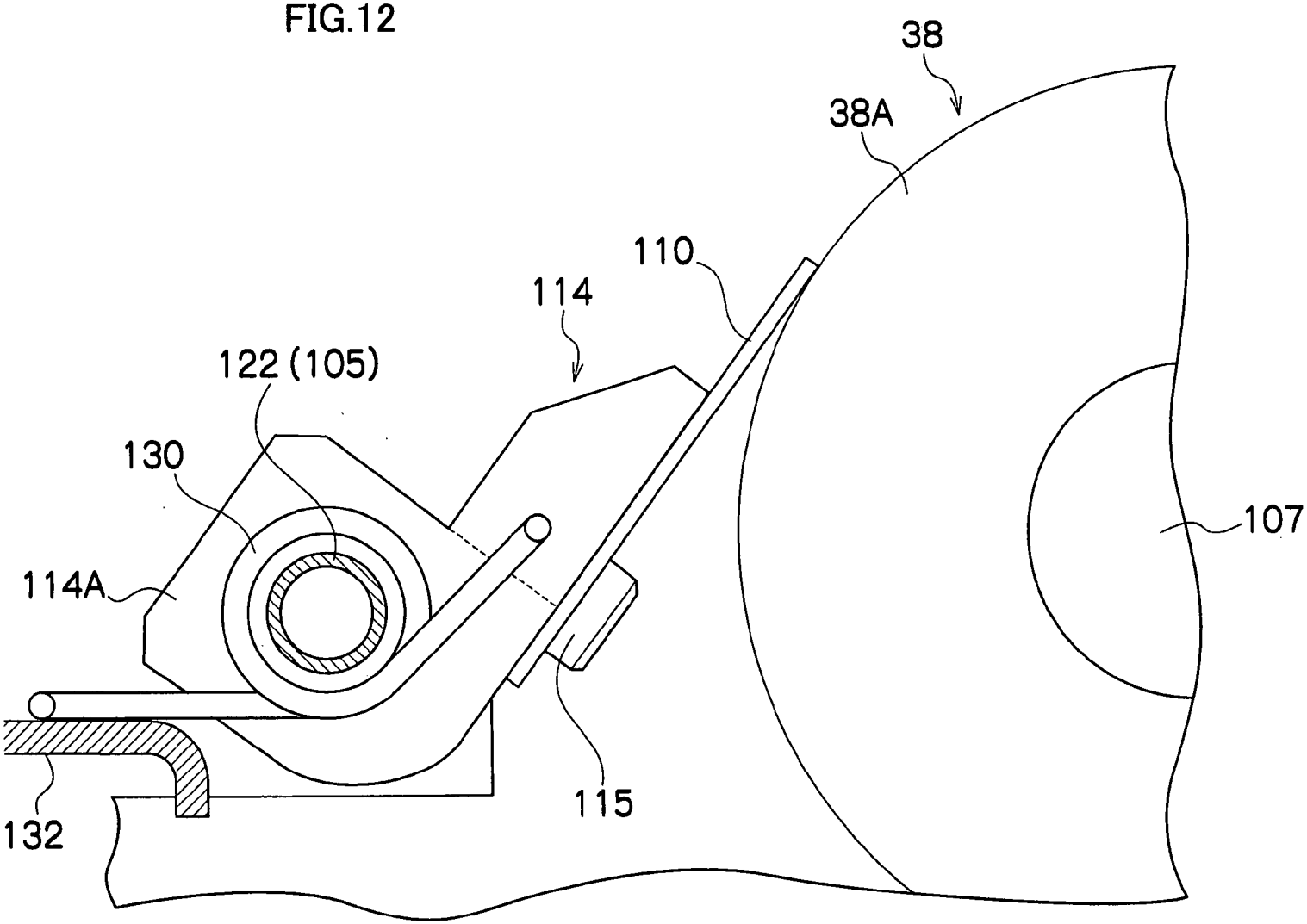
FIG. 12 is a principal cross-sectional diagram for describing a blade bracket of a liquid application apparatus.

A plurality of very fine cells (see FIGS. 9A and 9B) which are inscribed in a pyramid shape or a lattice shape (truncated pyramid shape) are formed at a prescribed density in the surface of the application section 38A of the gravure roller 38. There are no particular restrictions of the mode of arrangement of the cells on the surface of the application section 38A, but a desirable mode is one in which the cells are aligned in an oblique direction which is not perpendicular to the direction of rotation. The shape, depth, volume and density of the cells are selected appropriately in accordance with the amount of liquid which is to be coated (the thickness of the liquid film after application).

Furthermore, as shown in FIG. 8, the pressing rollers 116 and 118 are disposed on the opposite side of the gravure roller 38 (the upper side in FIG. 8) via the intermediate transfer body 12, to the upstream side and the downstream side of the gravure roller 38. The two pressing rollers 116 and 118 are disposed in parallel alignment at a prescribed interval apart in the conveyance direction of the intermediate transfer body 12, and the gravure roller 38 is disposed approximately at the midpoint between the two pressing rollers 116 and 118 in the direction of conveyance of the intermediate transfer body 12. The pressing rollers 116 and 118 are omitted from the image shown in FIG. 7.

As shown in FIG. 8, during application, the gravure roller 38 is pressed against the intermediate transfer body 12, and the intermediate transfer body 12 is pressed up between the pressing rollers 116 and 118. The intermediate transfer body 12 which is sandwiched between the gravure roller 38 and the pressing rollers 116, 118 is bent so as to following the upper circumferential surface of the gravure roller 38, and hence the adhesion with respect to the gravure roller 38 is raised and the contact surface area can also be guaranteed. By controlling the amount by which the gravure roller 38 is pressed against the intermediate transfer body 12, it is possible to adjust the angle of bending (angle of lap) of the intermediate transfer body 12 with respect to the gravure roller 38.

By conveying the intermediate transfer body 12 at a uniform speed in this nipped state and causing the gravure roller 38 to rotate in reverse with respect to the direction of conveyance of the intermediate transfer body, a thin film having a uniform film thickness can be applied to the image forming surface 12A of the intermediate transfer body 12 which forms the member receiving liquid application. In this case, the pressing rollers 116 and 118 rotate in a direction of rotation which follows the direction of conveyance, in accordance with the conveyance of the intermediate transfer body 12.

In the liquid application apparatus 100 according to the present embodiment, it is particularly desirable that the density of the cells of the gravure roller 38 should be 100 to 250 lines per inch (and further desirably, 150 to 200 lines per inch), and that the depth should be in the range of 45 to 70 μm. By this means, it is possible to apply a thin film having low visibility of the application pattern, and a uniform application thickness of 1 to 25 μm. Moreover, if the density of the cells is set to 150 to 165 lines/inch, then it is possible to form a uniform liquid film approximately 1 to 10 μm thick (more desirably, 1 to 5 μm and especially desirably, 1 to 3 μm), which is desirable in that there is no flow of liquid on the intermediate transfer body and it produces good fixing properties of coloring materials when ink droplets are ejected.

It is necessary to accelerate the speed of application of the treatment liquid 108 by the liquid application apparatus 100 in response to the high-speed printing performed by the inkjet recording apparatus 10, and desirably, the conveyance speed of the intermediate transfer body 12 is in the range of 500 to 660 mm per second (30 to 40 m per minute). Furthermore, in order to ensure stable application during high-speed application, desirably the rotational circumferential speed of the gravure roller 38 is made greater than the speed of conveyance of the intermediate transfer body 12, and preferably it is set to the range of 1.2 to 1.6 times in terms of the relative speed ratio. Consequently, if the conveyance speed of the intermediate transfer body 12 is set to 500 mm/sec, then it is desirable that the rotational circumferential speed of the gravure roller 38 should be set to the range of 600 to 800 (830) mm/second (36 to 50 m/min). In this case, if the diameter of the application section 38A is 30 mm, then the number of revolutions of the gravure roller 38 will be 380 to 530 rpm.

Furthermore, if the gravure roller 38 is rotated at high-speed in the rotational speed range described above, then the liquid surface in the liquid receiving pan 40 rises up on the side of the direction of rotation of the gravure roller 38 (the downstream side in terms of the direction of conveyance of the intermediate transfer body), and therefore the liquid surface on the side opposite to the direction of rotation (the upstream side) descends slightly. In particular, in terms of the composition of the treatment liquid 108, when the treatment liquid 108 contains a surfactant at a ratio of several percentage (%), then the rise in the liquid surface is especially notable and the treatment liquid 108 inside the liquid receiving pan 40 produces a foaming effect (phenomenon). This foaming effect induces defects in the filling of the treatment liquid 108 into the cells of the application section 38A of the gravure roller 38, and therefore in the present example, the occurrence of the foaming effect is suppressed and defects in the filling of treatment liquid 108 are thereby prevented, by increasing the amount of liquid supplied to the supply port 111.

Furthermore, desirably, the relationship between the width of the intermediate transfer body 12 and the width of the application section 38A is such that the width of the intermediate transfer body 12 is greater than that of the application section 38A. By this means, it is possible to prevent the treatment liquid 108 from flowing over onto the rear surface of the intermediate transfer body 12 (the upper surface of the intermediate transfer body in FIG. 8) if the treatment liquid 108 which has been applied to the intermediate transfer body 12 wets and spreads over the intermediate transfer body in the breadthways direction.

Next, the blade 110 and the blade bracket 114 which is a blade holding body will be described.

As shown in FIG. 7, FIG. 8, and FIG. 10 to FIG. 12, the blade 110 is formed in the shape of a thin plate, and is held on the blade bracket 114. The blade bracket 114 is supported rotatably on bracket supporting shafts 105 which are supported by a shaft supporting section 119 of the apparatus main body 117, and is biased toward the gravure roller 38 by a plurality of torsion springs 130 which are disposed equidistantly following the breadthways direction of the bracket (the axial direction of the gravure roller 38). By this means, the front tip of the blade 110 makes contact in a pressed state with the application section 38A of the gravure roller 38.

Desirably, the width of the blade 110 and the width of the application section 38A of the gravure roller 38 are substantially the same, but taking account of the assembly of the unit in the breadthways direction of the gravure roller 38, it is desirable that the width of the blade 110 should be at most approximately 1 mm longer than the width of the application section 38A.

Since the blade 110 is formed in the shape of a thin plate as described above, and the front tip thereof is pressed against the application section 38A of the gravure roller 38, then the front tip of the blade suffers wear during its use. Consequently, it is desirable that the blade 110 should be held detachably on the blade bracket 114 by means of a fastening device 115 such as a nut and bolt, or the like, (see FIG. 12). The thickness of the blade 110 is desirably in the range of 0.5 to 3.0 mm, and more desirably, in the range of 0.5 to 2.0 mm. In the present example, the thickness is taken to be 0.6 mm. The reason for this is that this range satisfies both the scraping properties of the treatment liquid 108 by the blade 110 and the strength of the blade 110. From the viewpoint of strength, the material of the blade 110 is desirably a metal material such as stainless steel, aluminum alloy, or the like, but it is also possible to use a resin material or a ceramic material.

In particular, as in the present embodiment, if the treatment liquid contains acid as a component, then from the viewpoint of the corrosion resistance with respect to the treatment liquid, stainless steel is desirable, and the stainless steel types SUS316 and SUS304 are most desirable. A plating treatment does not need to be carried out in the final finishing process, unlike a coating blade, and inspection to check for the presence of (plating) pinholes which may be caused by material defects or plating defects is not necessary. In general, a hard chromium plating is used for the plating treatment of the coating blade, but since the hard chromium plating is dissolved by an acid, then in terms of quality, it is not possible to withstand operational use.

From the viewpoint of the resistance to wear, a desirable mode of the present embodiment is one in which the blade 110 and the gravure roller 38 are made of the same material. Since the blade 110 and the gravure roller 38 have the same hardness, then the wear in the portion of contact between the blade 110 and the gravure roller 38 is reduced, and the difference between the rates of wear of these two members is reduced. As a result of this, the replacement frequency of the blade 110 is reduced and therefore the maintenance costs can be lowered.

A plurality of second bracket supporting shafts 122 are disposed in a bearing section (blade bracket bearing section) 114A of the blade bracket 114, following the breadthways direction. A torsion spring 130 which is a biasing device of the blade bracket 114 is supported in a rotatable fashion on each of the second bracket supporting shafts 122. Furthermore, bracket supporting shafts 124 are fitted into and supported by the blade bracket bearing sections 114A, so as to respectively cover the second bracket supporting shafts 122 and the torsion springs 130 which are supported on same.

Desirably, the first bracket supporting shafts 105 and the central axis of the second bracket supporting shaft 122 are composed in such a manner that their central axes are located in the same position. In this case, the second bracket supporting shafts 122 have a first function as supporting shafts for the torsion springs 130, as well as having a second function as supporting shafts of the blade bracket 114. By this means, it is possible to bias the blade bracket 114 efficiently toward the gravure roller 38, without giving rise to axial divergence. Of course, it is also possible to adopt a composition in which a single shaft member which serves as the first bracket supporting shaft 105 and the second bracket supporting shaft 122 passes through the blade bracket shaft bearing section 114A. Of course, it is also possible to adopt a composition in which a single shaft member which serves as the first bracket supporting shaft 105 and the second bracket supporting shaft 122 passes through the blade bracket shaft bearing section 114A.

One end of each torsion spring 130 is fitted into a groove section 126 formed in the partition wall of the blade bracket 114 and the other end thereof is supported by a spring receiving member 132 of the apparatus main body 117. By means of either end of each torsion spring 130 acting in the opening direction, the blade bracket 114 is biased toward the gravure roller 38, and the tip of the blade 110 which is held by the blade bracket 114 makes contact in a pressed state with the application section 38A of the gravure roller 38.

In the example shown in the drawings, either end section of each torsion spring 130 is formed into a key-shaped arm tip portion which is bent 90 degrees, but the arm tip portions of each torsion spring 130 do not necessarily have to be bent. In other words, the arm tip portions of the torsion springs 130 should be selected appropriately in accordance with the shape of the components upon which the torsion spring 130 acts, and for example, it can also be formed as a completely straight arm tip portion which does not have a bend portion.

The pressure with which the blade 110 makes contact with the application section 38A of the gravure roller 38 is desirably in the range of 0.2 to 20 gf/mm and more desirably in the range of 0.2 to 5 gf/mm.

In the present example, the specifications and the number of the torsion springs 130 is determined in such a manner that the pressure with which the blade 110 makes contact with the application section 38A of the gravure roller 38 is in the vicinity of 2 gf/mm. More specifically, considering that recording paper of A3 size (297 mm×420 mm) is conveyed in the longitudinal direction, the length of the gravure roller 38 in the axial direction is set to be 320 mm, and seven torsion springs 130 made of a material of SUS304 WPB, having a wire diameter of 1 mm and an internal diameter of 6 mm, and comprising four turns, are disposed at equidistant intervals following the breadthways direction of the bracket. In other words, seven torsion springs 130 having the same biasing force are disposed equidistantly in the breadthways direction of the bracket (the axial direction of the gravure roller 38).

From the viewpoint of achieving good performance in scraping off excess treatment liquid in the both end portions of the application section 38A of the gravure roller 38, it is desirable that the working points of the torsion springs 130 disposed at the respective both end portions in the breadthways direction of the bracket should be disposed in positions which are 20 mm or less from the respective side faces (end faces) 38B of the application section 38A of the gravure roller 38.

According to the liquid application apparatus 100 having the composition described above, even if the tip of the blade 110 suffers wear during use, the blade bracket 114 is continuously biased by the plurality of torsion springs 130 which are disposed in the breadthways direction of the bracket (the axial direction of the gravure roller 38), in such a manner that the tip of the blade 110 makes contact in a pressed state with the application section 38A of the gravure roller 38, and therefore no gap arises between the tip of the blade 110 and the application section 38A of the gravure roller 38, and it is possible to prevent decline in the performance in scraping off excess treatment liquid and to achieve application of a film of treatment liquid of uniform thickness onto the intermediate transfer body 12. Moreover, the replacement frequency of the blade 110 is reduced and therefore the maintenance costs can be lowered. Moreover, it is not necessary to measure the pressure with which the blade 110 makes contact with the application section 38A of the gravure roller 38 whenever the tip of the blade 110 suffers wear, and therefore maintenance can be simplified.

In particular, since a plurality of torsion springs 130 having the same biasing force are provided at equidistant intervals in the breadthways direction of the bracket (the axial direction of the gravure roller 38), then the pressure with which the tip of the blade 110 makes contact with the application section 38A of the gravure roller 38 is made uniform in terms of the axial direction of the gravure roller 38. Consequently, since wear of the tip of the blade 110 progresses in a uniform fashion in terms of the axial direction of the gravure roller 38, then it is possible reliably to prevent decline in the performance of scraping off the excess treatment liquid. As a result of this, it is possible to apply treatment liquid of a uniform thickness onto the intermediate transfer body 12, without the occurrence of application non-uniformities in the axial direction of the gravure roller 38.

In implementing the present invention, it is not absolutely necessarily for a plurality of torsion springs 130 having the same biasing force to be disposed at equidistant intervals in the breadthways direction of the bracket (the axial direction of the gravure roller 38). In other words, it is possible for the biasing forces of the plurality of torsion springs 130 to be mutually different, and it is also possible to dispose the plurality of torsion springs 130 at non-uniform intervals following the breadthways direction of the bracket. Since the biasing forces of the torsion springs 130 are transmitted to the blade 110 via the blade bracket 114 thereby creating a pressure with which the tip of the blade 110 makes contact with the application section 38A of the gravure roller 38, then by altering the biasing force and the positioning interval of the plurality of torsion springs 130 appropriately in accordance with the state of the blade bracket 114, in other words, in accordance with the rigidity of the blade bracket 114, it is possible to make the pressure with which the tip of the blade 110 makes contact with the application section 38A of the gravure roller 38 uniformly throughout the axial direction of the gravure roller 38, and beneficial results which are equivalent to those of the embodiment described above can be obtained.

Moreover, it is possible to achieve a mechanism for causing the blade to make contact with the gravure roller at a prescribed pressing force by means of a smaller number of constituent parts in comparison with a conventional system (more specifically, the invention described in Japanese Patent Application Publication No. 2006-255611), and the liquid application apparatus 100 can be made compact in size.

Moreover, in the present example, torsion springs 130 are used as devices for biasing the blade bracket 114 in such a manner that the tip of the blade 110 makes contact in a pressed state with the application section 38A of the gravure roller 38, but the implementation of the present invention is not limited to this example and it is also possible to use other biasing devices (for instance, leaf springs, or the like).

However, a desirable mode is one in which torsion springs are used as the biasing devices, as in the present example. It is possible to change the biasing force readily by adjusting the number of turns of the twist-coil torsion spring, the diameter of the spring wire, the external diameter of the spring, or the like. Furthermore, it is also possible to obtain a sufficient biasing force by making the torsion springs compact in size and providing a plurality of such springs. As a result of this, the performance in scraping off excess treatment liquid can be made uniform throughout the axial direction of the gravure roller 38 and a treatment liquid film of uniform thickness can be applied to the intermediate transfer body 12. Moreover, it is also possible to achieve a compact composition and therefore to make the liquid application apparatus 100 compact in size.

Second Example of Liquid Application Apparatus

In the second example, of the plurality of torsion springs 130 (in the present example, seven springs) which are disposed at equidistant intervals in the breadthways direction of the blade bracket 114 (the axial direction of the gravure roller 38), the biasing force of first torsion springs 130A which are positioned in the respective end portions is designed to be slightly greater than the biasing force of second torsion springs 130B which are positioned in the region other than the respective end portions (in other words, in the central portion) (see FIG. 7). More specifically, a composition is adopted in which the pressure with which the tip of the blade 110 makes contact with the application section 38A of the gravure roller 38 is made to be higher in the respective end portions than the pressure in the central portion in terms of the axial direction of the gravure roller 38. The point of setting the pressure with which the blade 110 makes contact with the application section 38A of the gravure roller 38 to be in the vicinity of 2 gf/mm is the same as that of the first example.

More specifically, two first torsion springs 130A made of the material SUS304 WPB, having a wire diameter of 1 mm and an internal diameter of 6 mm, and comprising four turns, are disposed in the respective end portions in the breadthways direction of the blade bracket 114, and furthermore, between these springs, five second torsion springs 130B made of the material SUS304 WPB, having a wire diameter of 1 mm and an internal diameter of 6 mm, and comprising five turns, are disposed at equidistant intervals.

From the viewpoint of achieving good performance in wiping off excess treatment liquid in the respective end portions of the application section 38A of the gravure roller 38, it is desirable that the working points of the first torsion springs 130A disposed in the respective end portions in the breadthways direction of the blade bracket 114 should be disposed in positions which are 20 mm or less from the respective side faces (end faces) 38B of the application section 38A of the gravure roller 38.

By means of this composition, even if the excess treatment liquid which is not scraped off completely from the gravure roller 38 by the blade 110 travels along the blade 110 and moves to the respective end portions of the application section 38A of the gravure roller 38 and hence the amount of excess treatment liquid at the respective end portions increases, it is still possible reliably to prevent the treatment liquid from infiltrating through the gap (in other words, the boundary surface) with the application section 38A of the gravure roller 38 against the pressing force of the blade 110. In other words, the performance in scraping off excess treatment liquid is made uniform throughout the axial direction of the gravure roller 38 and a treatment liquid film of uniform thickness can be applied to the intermediate transfer body 12.

A desirable mode of the present invention is one where the biasing force of the respective torsion springs 130 increases in a stepwise fashion from the central portion toward the end portions in the breadthways direction of the blade bracket 114 (the axial direction of the gravure roller 38). Since the pressure with which the tip of the blade 110 makes contact with the application section 38A of the gravure roller 38 gradually becomes greater from the central portion toward the end portions in the breadthways direction of the blade bracket 114, then the performance in scraping off excess treatment liquid is made even more uniform in the axial direction of the gravure roller 38, and hence application of a more uniform film thickness becomes possible.

Description of Control System

Figure 13:
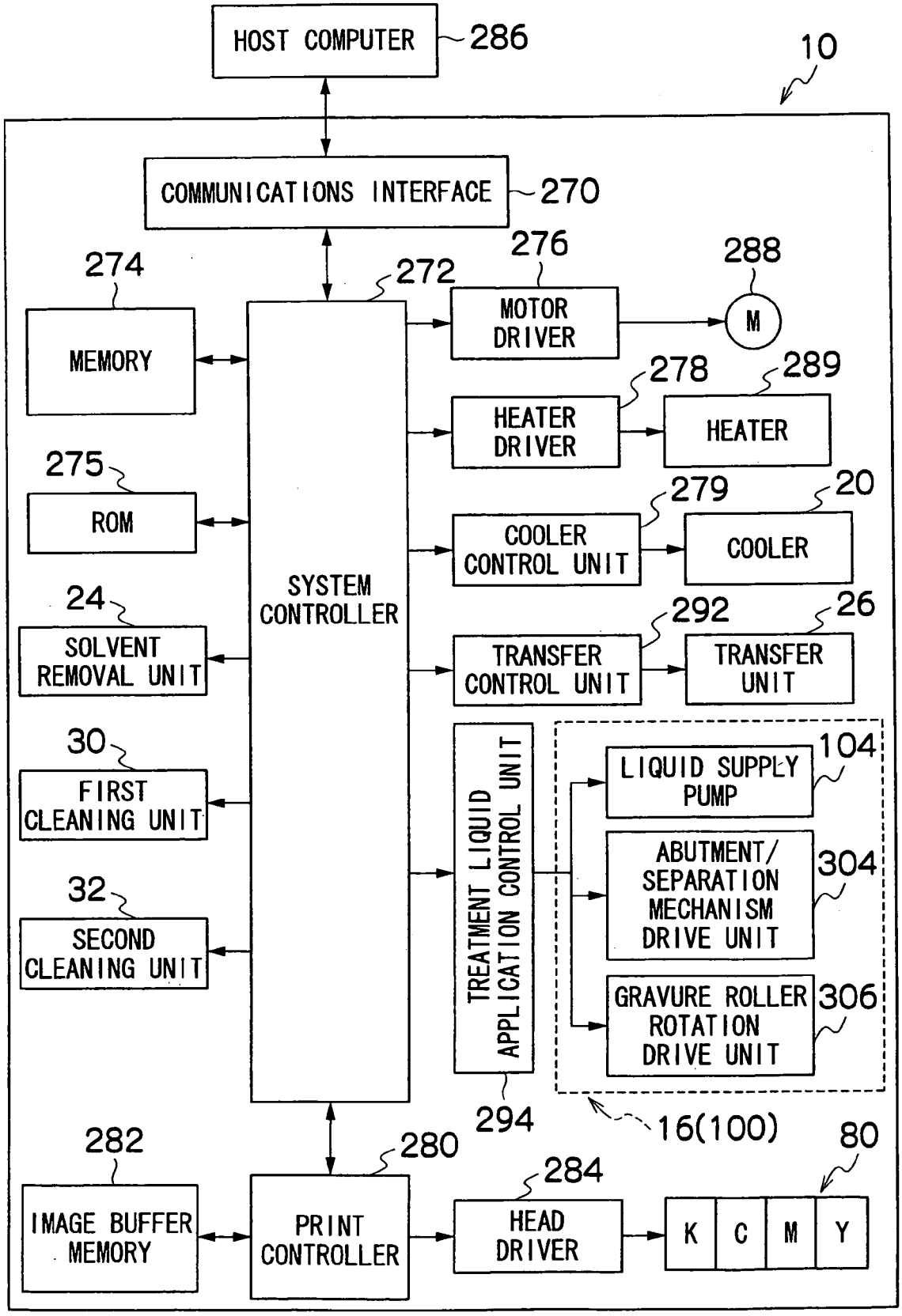
FIG. 13 is a block diagram showing a system configuration of the inkjet recording apparatus according to the first embodiment.

FIG. 13 is a principal block diagram showing the system configuration of the inkjet recording apparatus 10. The inkjet recording apparatus 10 comprises a communications interface 270, a system controller 272, a memory 274, a motor driver 276, a heater driver 278, a cooler control unit 279, a print controller 280, an image buffer memory 282, a head driver 284, and the like.

The communications interface 270 is an interface unit for receiving image data sent from a host computer 286. A serial interface such as USB (Universal Serial Bus), IEEE1394, Ethernet (registered trademark), wireless network, or a parallel interface such as a Centronics interface may be used as the communications interface 270. A buffer memory (not shown) may be mounted in this portion in order to increase the communication speed. The image data sent from the host computer 286 is received by the inkjet recording apparatus 10 through the communications interface 270, and is temporarily stored in the memory 274.

The memory 274 is a storage device for temporarily storing images inputted through the communications interface 270, and data is written and read to and from the memory 274 through the system controller 272. The memory 274 is not limited to a memory composed of semiconductor elements, and a hard disk drive or another magnetic medium may be used.

The system controller 272 is constituted by a central processing unit (CPU) and peripheral circuits thereof, and the like, and it functions as a control device for controlling the whole of the inkjet recording apparatus 10 in accordance with prescribed programs, as well as a calculation device for performing various calculations. More specifically, the system controller 272 controls the various sections, such as the communications interface 270, memory 274, motor driver 276, heater driver 278, cooler control unit 279 and the like, as well as controlling communications with the host computer 286 and writing and reading to and from the memory 274, and it also generates control signals for controlling the heater 289 and the motor 288 of the conveyance system.

Programs executed by the CPU of the system controller 272 and the various types of data which are required for control procedures are stored in the ROM 275. The ROM 275 may be a non-writeable storage device, or it may be a rewriteable storage device, such as an EEPROM. The memory 274 is used as a temporary storage region for the image data, and it is also used as a program development region and a calculation work region for the CPU.

The motor driver 276 is a driver which drives the motor 288 in accordance with instructions from the system controller 272. In FIG. 13, the motors disposed in the respective sections in the apparatus are represented by the reference numeral 288. For example, the motor 288 shown in FIG. 13 comprises a motor which drives the drive rollers in the tensioning rollers 34A to 34C in FIG. 1, a motor of the movement mechanism of the solvent removal roller 42, a motor of the movement mechanisms of the transfer roller 36 and the pressurization roller 48, and the like.

The heater driver 278 shown in FIG. 13 is a driver which drives the heater 289 in accordance with instructions from the system controller 272. In FIG. 13, the plurality of heaters which are provided in the inkjet recording apparatus 10 are represented by the reference numeral 289. For instance, the heater 289 shown in FIG. 13 includes the heater of a heating unit 18 shown in FIG. 1, a pre-heater 46, and the like.

The cooler control unit 279 in FIG. 13 is a control unit which controls the temperature of the cooler 20 (see FIG. 1) in accordance with instructions from the system controller 272.

The print controller 280 has a signal processing function for performing various tasks, compensations, and other types of processing for generating print control signals from the image data stored in the memory 274 in accordance with commands from the system controller 272 so as to supply the generated print data (dot data) to the head driver 284. Required signal processing is carried out in the print controller 280, and the ejection amount and the ejection timing of the ink droplets from the respective print heads 80 are controlled via the head driver 284, on the basis of the print data. By this means, desired dot size and dot positions can be achieved.

The print controller 280 is provided with the image buffer memory 282; and image data, parameters, and other data are temporarily stored in the image buffer memory 282 when image data is processed in the print controller 280. The aspect shown in FIG. 13 is one in which the image buffer memory 282 accompanies the print controller 280; however, the memory 274 may also serve as the image buffer memory 282. Also possible is an aspect in which the print controller 280 and the system controller 272 are integrated to form a single processor.

To give a general description of the sequence of processing from image input to print output, image data to be printed (original image data) is input from an external source via the communications interface 270, and is accumulated in the memory 274. At this stage, RGB image data is stored in the memory 274, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 274 is sent to the print controller 280 through the system controller 272, and is converted to the dot data for each ink color by a half-toning technique, using a threshold value matrix, error diffusion, or the like, in the print controller 280.

In other words, the print controller 280 performs processing for converting the input RGB image data into dot data for the four colors of K, C, M and Y The dot data generated by the print controller 280 in this way is stored in the image buffer memory 282. The primary image formed on the intermediate transfer body 12 must be a mirror image of the secondary image which is to be formed finally on the recording medium 14, taking account of the fact that it is reversed when transferred onto the recording medium. In other words, the drive signals supplied to the heads 22Y, 22M, 22C and 22K are drive signals corresponding to a mirror image, and therefore the input image must be subjected to reversal processing by the print controller 280.

The head driver 284 outputs drive signals for driving the actuators 88 corresponding to the respective nozzles 81 of the heads 80, on the basis of the print data supplied by the print controller 280 (in other words, the dot data stored in the image buffer memory 282). A feedback control system for maintaining constant drive conditions in the head may be included in the head driver 284.

By supplying the drive signals output by the head driver 284 to the print heads 80, ink is ejected from the corresponding nozzles 81. An image (primary image) is formed on the intermediate transfer body 12 by controlling ink ejection from the heads 80 while conveying the intermediate transfer body 12 at a prescribed speed.

Furthermore, the system controller 272 controls the transfer control unit 292 and the treatment liquid application control unit 294, and furthermore, it also controls the operation of the solvent removal unit 24, the first cleaning unit 30 and the second cleaning unit 32, as shown in FIG. 1.

The transfer control unit 292 shown in FIG. 13 controls the temperature and the nip pressure of the transfer roller 36 of the transfer unit 26 and the pressure roller 48 (see FIG. 1). The optimal values for the nip pressure and transfer temperature (target control values) are previously determined for each type of recording medium and each type of ink, and this data is stored in a prescribed memory (for example, the ROM 275) in the form of a data table. When the system controller 272 acquires information about the recording medium 14 being used and the ink being used, on the basis of an input made by an operator, or by automatically reading in information from a prescribed sensor, then the system controller 272 controls the temperature and the nip pressure of the transfer roller 36 and the pressurization roller 48 accordingly, by referring to the data table.

The treatment liquid application control unit 294 shown in FIG. 13 controls the operation of the treatment liquid application unit 16 in accordance with instructions from the system controller 272. If a liquid application apparatus 100 as shown in FIG. 7 to FIG. 12 is used for the treatment liquid application unit 16, then as shown in FIG. 13, the liquid supply pump 104, the abutment/separation mechanism drive unit 304 for the gravure roller, the gravure roller rotation drive unit 306, and the like, are controlled by the treatment liquid application control unit 294.

The first embodiment which is described above relates to an example in which after applying an aggregating treatment agent (treatment liquid), the treatment agent is caused to dry so as to form a solid or semi-solid aggregating treatment agent layer, and droplets of ink are then ejected onto this layer, but a mode is also possible in which an aggregating treatment agent is depositing after ejecting droplets of ink. Below, this mode is described as a second embodiment.

Second Embodiment

Figure 14:
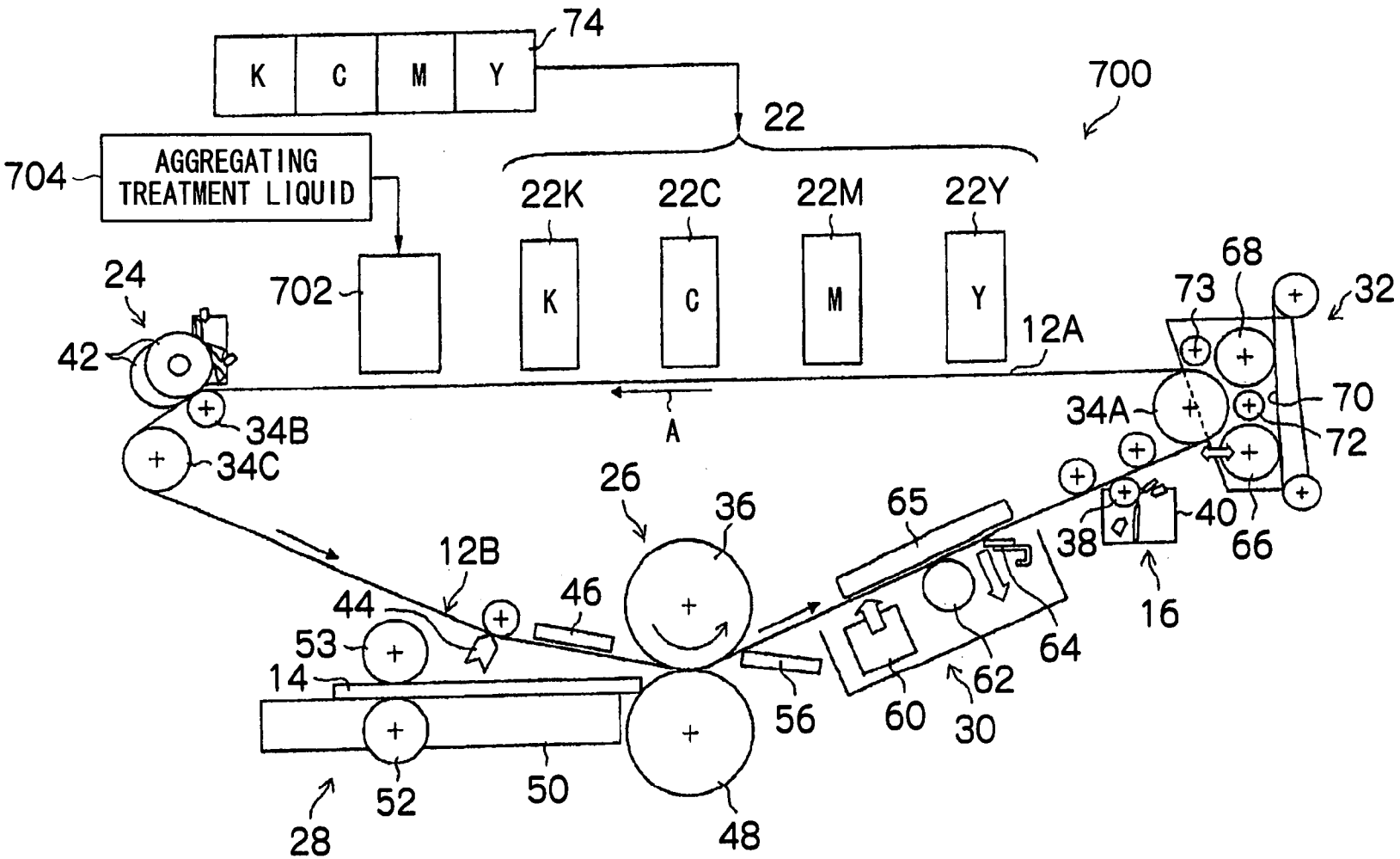
FIG. 14 is a general schematic drawing of an inkjet recording apparatus relating to a second embodiment of the present invention.

FIG. 14 is a schematic drawing of an inkjet recording apparatus 700 relating to a second embodiment. In FIG. 14, elements which are the same as or similar to the composition in FIG. 1 are labeled with the same reference numerals and description thereof is omitted here.

In the inkjet recording apparatus 700 shown in FIG. 14, the undercoating liquid which is applied by the treatment liquid application unit 16 differs from the example in FIG. 1, and a liquid ejection head which deposits an aggregating treatment liquid (hereinafter, called "aggregating liquid head") 702 is provided on the downstream side of the print unit 22, instead of the heating unit 18 and cooler 20 in FIG. 1.

In other words, the inkjet recording apparatus 700 shown in the present example employs a three-liquid image forming method, in which a first treatment liquid layer is formed by means of an undercoating liquid (hereinafter, called the "first treatment liquid") on the intermediate transfer body 12, droplets of ink are ejected into this first treatment liquid layer, and then droplets of an aggregating treatment liquid (hereinafter, called the "second treatment liquid") which has the function of causing the ink droplets to aggregate are ejected, in accordance with the liquid ink droplets in the first treatment liquid layer, thereby causing the coloring material (pigment) in the ink to aggregate and thus forming an ink aggregate.

The first treatment liquid which is applied by the treatment liquid application unit 16 of this inkjet recording apparatus 700 is a liquid which does not have the function of aggregating the ink droplets, even if it makes contact with the ink droplets; for example, a liquid obtained by removing the coloring material (pigment) from the ink liquid used in the print unit 22 can be used as the first treatment liquid. An example of the preparation of the first treatment liquid is shown in Table 5.

TABLE 5

| Material | Weight % |
|---|---|
| Latex LX-2 | 8 |
| Glycerine (made by Wako Pure Chemical Industries, Ltd.) | 20 |
| Diethylene glycol (made by Wako Pure Chemical Industries, Ltd.) | 10 |
| Olfine E1010 (made by Nissin Chemical Industry Co., Ltd.) | 1 |
| Ion-exchanged water | 61 |

The aggregating treatment liquid (second treatment liquid) ejected from the aggregating liquid head 702 is desirably a treatment liquid which has the function of generating an ink aggregate by causing the pigment (coloring material) and the polymer micro-particles contained in the ink to aggregate by altering the pH of the ink.

The aggregating treatment liquid storing and loading unit 704 shown in FIG. 14 is constituted by a tank which stores the second treatment liquid which is supplied to the aggregating liquid head 702. The tank is connected to the treatment liquid head 702 via a prescribed flow channel.

The aggregating liquid head 702 according to the present embodiment uses the same composition as the head disposed in the print unit 22. Provided that it is possible to deposit aggregating treatment liquid by a non-contact method onto the intermediate transfer body 12, the aggregating liquid head 702 may adopt a structure having a reduced droplet ejection density (resolution) compared to the ink heads 22Y, 22M, 22C and 22K, and it may also adopt a method other than an inkjet method, such as a spray method.

Desirably, the component of the second treatment liquid is selected from: polyacrylic acid, acetic acid, glycol acid, malonic acid, malic acid, malleinic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, and derivatives of these compounds, and salts of these, and the like.

A desirable example of the second treatment liquid is a treatment liquid to which a multivalent salt or polyallylamine has been added. These compounds may be used singly, or a combination of two or more of these compounds may be used.

From the viewpoint of the pH aggregating performance with respect to the ink, the second treatment liquid desirably has a pH of 1 to 6, more desirably, a pH of 2 to 5, and particularly desirably, a pH of 3 to 5.

The added amount, in the second treatment liquid, of the compound which causes aggregation of the ink pigment and polymer micro-particles, is desirably equal to or greater than 0.01 wt % and equal to or less than 20 wt %, with respect to the total weight of the liquid. If the amount is equal to or less than 0.01 wt %, then when the ink comes into contact with the second treatment liquid, the concentration and dispersion do not advance sufficiently, and a sufficient aggregating action on the basis of the pH change may not be produced. Furthermore, if the amount is equal to or greater than 20 wt %, then there are concerns over deterioration of the ejection performance from the inkjet head (for example, the occurrence of ejection abnormalities).

Desirably, the second treatment liquid contains water and another organic solvent which is capable of dissolving the additive, in order to prevent blocking of the nozzles of the ejection head (702) due to drying. The water or other organic solvent capable of dissolving the additive includes a moistening agent or a penetrating agent. These solvents can be used independently, or in plural fashion, together with the other additive.

The content of the water and the other organic solvent capable of dissolving the additive should desirably be equal to or less than 60 wt % with respect to the total weight of the second treatment liquid. If the content is equal to or greater than 60 wt %, then the viscosity of the treatment liquid increases, and the ejection characteristics from the inkjet head may deteriorate.

It is also possible to include a resin component in the second treatment liquid in order to improve the fixing characteristics and weatherproofing (abrasion-resistance performance). The resin component may be any resin which would not impair the ejection characteristics from the head if the treatment liquid is ejected in the form of droplets by an inkjet method, and which has stable storage characteristics, and it is possible freely to choose a water-soluble resin, resin emulsion, or the like.

The resin component may be an acrylic polymer, a urethane polymer, a polyester polymer, a vinyl polymer, a styrene polymer, or the like. In order to display sufficiently the functions of the material in improving fixing characteristics, it is necessary to add a polymer of relatively high molecular weight, at a high concentration (1 wt % to 20 wt %). However, if it is sought to add the aforementioned materials by dissolving in the liquid, then the liquid acquires a high viscosity and the ejection characteristics decline. In order to add a suitable material at a high density or to suppress increase in the viscosity, it is effective to add a material in the form of a latex. Possible latex materials are, for instance: an alkyl copolymer of acrylic acid, carboxyl-modified SBR (styrene—butadiene latex), SIR (styrene—isoprene latex), MBR (methyl methacrylate—butadiene latex), NBR (acrylonitrile—butadiene latex), and the like.

The glass transition point Tg of the latex has a significant effect during the fixing process, and desirably, it is equal to or greater than 50° C. or equal to or less than 120° C., in order to achieve both the stability during storage at normal temperature and good transfer characteristics after heating. Moreover, during the process, the minimum film forming temperature MFT also has a significant effect on fixing and in order to achieve suitable fixing at low temperatures, desirably it is 100° C. or lower, and more desirably, 50° C. or lower.

A desirable mode is one where the second treatment liquid contains polymer micro-particles of opposite polarity to the ink, since this further enhances the aggregating properties by causing aggregation of the pigment and polymer micro-particles in the ink. Furthermore, the aggregating properties may be enhanced by including, in the second treatment liquid, a curing agent which corresponds to the polymer micro-particle component contained in the ink, in such a manner that the resin emulsion in the ink composition aggregates and produces a cross-linking or polymerization reaction, after the ink and second treatment liquid have come into contact.

The second treatment liquid may contain a surfactant. Desirable examples of a surfactant are: in a hydrocarbon system, an anionic surface active agent, such as a salt of a fatty acid, an alkyl sulfate ester salt, an alkyl benzene sulfonate salt, an alkyl naphthalene sulfonate, a dialkyl sulfosuccinate salt, an alkyl phosphate ester salt, a naphthalene sulfonate/formalin condensate, a polyoxyethylene alkyl sulfonate ester salt, or the like; or a non-ionic surface active agent, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerine fatty acid ester, an oxyethylene oxypropylene block copolymer, and the like.

Furthermore, it is also desirable to use SURFYNOLS (Air Products & Chemicals Co. Ltd.), which is an acetylene-based polyoxyethylene oxide surface active agent. Furthermore, an amine oxide type of amphoteric surface active agent, such as N,N-dimethyl-N-alkyl amine oxide, is also desirable. Moreover, for the surfactant of the second treatment liquid, it is possible to use one of the materials cited as a surfactant in pages 37 to 38 of Japanese Patent Application Publication No. 59-157636 or one of the materials cited as a surfactant in Research Disclosure No. 308119 (1989).

Furthermore, it is also possible to use a fluorine (alkyl fluoride) type, or silicone type of surface active agent such as those described in Japanese Patent Application Publication No. 2003-322926, Japanese Patent Application Publication No. 2004-325707, and Japanese Patent Application Publication No. 2004-309806. It is also possible to use a surface tension adjuster of this kind as an anti-foaming agent; and a fluoride or silicone compound, or a chelating agent, such as EDTA, can also be used.

If the surfactant described above is included in the second treatment liquid, then a beneficial effect is obtained in that the surface tension of the second treatment liquid is lowered and the wetting properties on the intermediate transfer body are improved. Desirably, the surface tension of the second treatment liquid is 10 to 50 mN/m, and in the case of application by means of an inkjet method, more desirably, the surface tension of the second treatment liquid is 15 to 45 mN/m from the viewpoint of achieving finer liquid droplets and improving the ejection performance.

Desirably, the viscosity of the second treatment liquid is 1.0 to 20.0 cP, from the viewpoint of depositing by means of an inkjet method. It is also possible to add, to a second treatment liquid, a pH buffering agent, an anti-oxidation agent, an anti-rusting agent, a viscosity adjusting agent, a conducting agent, an ultraviolet light absorbing agent, and the like.

Figure 15:
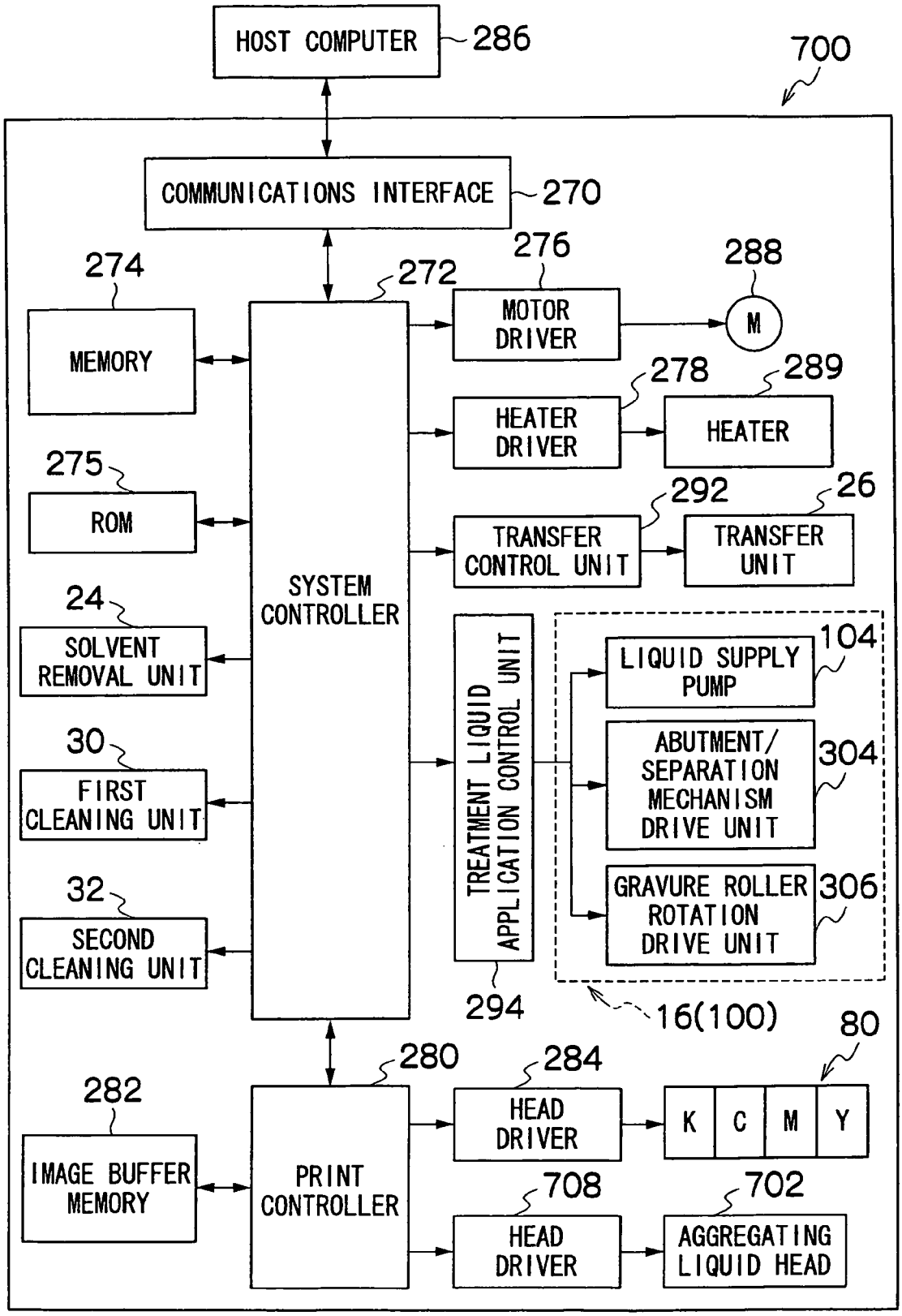
FIG. 15 is a block diagram showing a system configuration of the inkjet recording apparatus according to the second embodiment.

FIG. 15 is a block diagram of the inkjet recording apparatus 700 shown in FIG. 14. In FIG. 15, elements which are the same as or similar to the example in FIG. 14 are labeled with the same reference numerals and description thereof is omitted here.

In the inkjet recording apparatus 700 shown in FIG. 15, the aggregating liquid head 702 and a head driver 708 which drives this head are provided as devices for depositing the aggregating treatment liquid (second treatment liquid). The head driver 708 generates drive signals to be applied to the actuators 88 of the aggregating liquid head 702, on the basis of image data supplied from the print controller 280, and also comprises drive circuits which drive the actuators 88 by applying the drive signals to the actuators 88. In this way, a desirable mode is one in which a composition for ejecting droplets of aggregating liquid in accordance with the image data is adopted, and droplets of aggregating treatment liquid are ejected selectively onto the positions where droplets of ink have been ejected by the print unit 22, but it is also possible to adopt a mode in which the aggregating liquid is deposited in a uniform fashion by using a spray nozzle.

Furthermore, in the respective embodiments described above, an endless belt is used as the intermediate transfer body, but it is also possible to adopt a mode which uses a drum-shaped intermediate transfer body. In this case, from the viewpoint of the processing characteristics and the thermal control characteristics, it is desirable to use an intermediate transfer body formed by coating a fluorine elastomer onto the surface of a thin aluminum tube which is reinforced by ribs. Furthermore, in the respective embodiments described above, an example is described in which a treatment liquid is applied to an intermediate transfer body and then transferred onto a recording medium, but liquid application apparatuses according to the present invention can also be used in a recording method where a treatment liquid is applied directly to the recording medium without passing via an intermediate transfer body.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus comprising:

a rotatable coating cylinder which has a circumferential surface onto which an application liquid is supplied at a lower portion of the rotatable coating cylinder, an upper portion of the circumferential surface of the rotatable coating cylinder being configured to make contact with a base member which has a band shape and is conveyed continuously;

a blade which scrapes off excess liquid of the application liquid which has been supplied to the circumferential surface of the rotatable coating cylinder in such a manner that a prescribed amount of the application liquid remains on the circumferential surface of the rotatable coating cylinder, before the upper portion of the circumferential surface of the rotatable coating cylinder transfers, onto the base member, the application liquid from which the excess liquid has been removed by the blade;

a blade holding body which holds the blade, is supported on a supporting shaft and is rotatable in a rotational direction; and a plurality of biasing devices which are disposed in an axial direction of the rotatable coating cylinder and bias the blade holding body in the rotation direction of the blade holding body in such a manner that the blade makes contact with the circumferential surface of the rotatable coating cylinder, wherein of the plurality of biasing devices, the biasing devices disposed at end portions of the rotatable coating cylinder in the axial direction have greater biasing force than the biasing devices other than the biasing devices disposed at the end portions of the rotatable coating cylinder.

2. The liquid application apparatus as defined in claim 1, wherein the plurality of biasing devices are disposed at equidistant intervals in the axial direction of the rotatable coating cylinder.

3. The liquid application apparatus as defined in claim 1, wherein biasing force of the plurality of biasing devices increases in a stepwise fashion in terms of the axial direction from a central portion of the rotatable coating cylinder toward end portions of the rotatable coating cylinder.

4. The liquid application apparatus as defined in claim 1, wherein the plurality of biasing devices are torsion springs.

5. The liquid application apparatus as defined in claim 1, wherein the blade and the rotatable coating cylinder are made of a same material.

6. A liquid application apparatus comprising:

a rotatable coating cylinder which has a circumferential surface onto which an application liquid is supplied at a lower portion of the rotatable coating cylinder, an upper portion of the circumferential surface of the rotatable coating cylinder being configured to make contact with a base member which has a band shape and is conveyed continuously;

a blade which scrapes off excess liquid of the application liquid which has been supplied to the circumferential surface of the rotatable coating cylinder in such a manner that a prescribed amount of the application liquid remains on the circumferential surface of the rotatable coating cylinder, before the upper portion of the circumferential surface of the rotatable coating cylinder transfers, onto the base member, the application liquid from which the excess liquid has been removed by the blade;

a blade holding body which holds the blade, is supported on a supporting shaft and is rotatable in a rotation direction; and a plurality of biasing devices which are disposed in an axial direction of the rotatable coating cylinder and bias the blade holding body in the rotation direction of the blade holding body in such a manner that the blade makes contact with the circumferential surface of the rotatable coating cylinder, wherein biasing force of the plurality of biasing devices increases in a stepwise fashion in terms of the axial direction from a central portion of the rotatable coating cylinder toward end portions of the rotatable coating cylinder.

* * * * *